US007628558B2

(12) United States Patent
Takeshita et al.

(10) Patent No.: US 7,628,558 B2
(45) Date of Patent: Dec. 8, 2009

(54) TRANSPORT SYSTEM, RECORDING APPARATUS AND LIQUID EJECTION APPARATUS

(75) Inventors: Sanshiro Takeshita, Nagano (JP); Eiichi Miyashita, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 319 days.

(21) Appl. No.: 11/501,753

(22) Filed: Aug. 10, 2006

(65) Prior Publication Data

US 2007/0036606 A1 Feb. 15, 2007

(30) Foreign Application Priority Data

Aug. 10, 2005 (JP) ..... P2005-231778
Aug. 19, 2005 (JP) ..... P2005-238260

(51) Int. Cl.
*B41J 13/00* (2006.01)

(52) U.S. Cl. ..... 400/642; 400/578; 400/649

(58) Field of Classification Search ..... None
See application file for complete search history.

(56) References Cited

FOREIGN PATENT DOCUMENTS

| | | | |
|---|---|---|---|
| JP | 2002-355956 | A | 12/2002 |
| JP | 2003-211757 | A | 7/2003 |
| JP | 2004-42392 | A | 2/2004 |
| JP | 2004-130774 | A | 4/2004 |
| JP | 2005-104136 | A | 4/2005 |

*Primary Examiner*—Judy Nguyen
*Assistant Examiner*—Marissa L Ferguson-Samreth
(74) *Attorney, Agent, or Firm*—Sughrue Mion, PLLC

(57) ABSTRACT

A transport system includes a guide, operable to guide a transported medium in a transport direction; a driver, disposed at a downstream side of the guide in the transport direction, and operable to come into contact with a bottom surface of the transported medium; a presser, disposed between the guide and the driver, and operable to be displaced between a pressing position where the presser presses an upper surface of the transported medium toward the driver and a non-pressing position where the presser is separated from the upper surface of the transported medium; and a changer, adapted to be engaged with the transported medium so as to displace the presser to the pressing position from the non-pressing position, wherein a leading end of the transported medium reaches the driver before or at a time when the presser presses the transported medium.

3 Claims, 26 Drawing Sheets

TRANSPORT SYSTEM, RECORDING APPARATUS AND LIQUID EJECTION APPARATUS

BACKGROUND OF THE INVENTION

The present invention relates to a recording apparatus that has a recording unit for recording data on a recorded medium and includes a transported medium having a plate form and capable to be transported and a linear transport path on which the transported medium having the plate form can be transported. Further, the present invention relates to a liquid ejection apparatus.

Here, the liquid ejection apparatus is not limited to a recording apparatus such as a printer, a copying machine and a facsimile device in which an ink jet type recording head is used and ink is ejected from the recording head to record data on a recorded medium and is employed in a sense that liquid corresponding to its use is ejected, instead of the ink, to an ejected medium corresponding to the recorded medium from a liquid ejection head corresponding to the ink jet type recording head to allow the liquid to adhere to the ejected medium.

As the liquid ejection head, exemplified are, as well as the recording head, a coloring material ejection head used for producing a color filter of a liquid crystal display, an electrode material (electric conductive paste) ejection head used for forming an electrode of an organic EL display or a face light emitting display (FED), a biological organic material ejection head used for producing a bio-chip, a sample ejection head as a precise pipette, etc.

As an ink jet printer as one example of the recording apparatus or the liquid ejection apparatus, a printer is known in which an optical disk as a thin plate shaped member such as a CD-R or a DVD is used as a recorded medium and ink droplets are directly ejected on a label surface thereof to record data. In such an ink jet printer, as disclosed in, for instance, JP-A-2005-104136, the thin plate shaped member such as the optical disk is set on a tray as a transported medium having a plate form and is transported (a sub-scanning feed) on a transport path in the ink jet printer under a state that the plate shaped member is set to perform an ink recording on the label surface.

Further, in a front part of the device of the ink jet printer, as disclosed in the JP-A-2005-104136, a tray guide as a guide unit for guiding the tray is provided, the tray on which the optical disk is set is inserted into the inner part of the device from an upper part of the tray guide, and then, after the recording on the optical disk is completed, the optical disk is ejected to the tray guide.

Under a state that the tray is nipped by a transport driving roller and a transport follower roller provided in the upstream side of a recording head, the transport driving roller rotates to sub-scanning feed the tray. Accordingly, to allow the tray to be sub-scanning fed by the transport driving roller and the transport follower roller, after the tray is inserted from the upper part of the tray guide, an end of the tray needs to enter a part between the transport driving roller and the transport follower roller.

This operation is carried out in such a way, as shown in JP-A-2002-355956, that a unit (release) for separating the transport follower roller from the transport driving roller is provided, the transport follower roller is separated from the transport driving roller by the operation of a user, then, the tray is inserted from the upper part of the tray guide, and then, after the end of the tray reaches the part between the transport driving roller and the transport follower roller, the transport follower roller is returned to an original position.

Here, a sheet ejection unit provided in the downstream side of the recording head includes an ejecting driving roller that is rotated and driven and an ejecting follower roller that is driven and rotated in contact with the ejecting driving roller. As the ejecting follower roller, a toothed roller (a spur roller) having teeth on its outer periphery is used to prevent the void of ink or ink from rolling and adhering.

Accordingly, for instance, when a pressing roller for pressing the tray toward the ejecting driving roller is separately provided from the ejecting follower roller in the side of the tray guide with respect to the ejecting follower roller and the tray is fed to the transport driving roller and the transport follower roller by rotating the ejecting driving roller so that the end of the tray can enter the part between the transport driving roller and the transport follower roller, the unit for releasing the transport follower roller form the transport driving roller is not necessary. Thus, a cost can be lowered and a serviceability of a user can be improved.

In this case, since the bottom surface of the tray needs to assuredly come into contact with the ejecting driving roller, the ejecting driving roller needs to be arranged at a position slightly higher than a support surface of the tray guide for supporting the tray. However, in such a structure, when the tray is inserted from the upper part of the tray guide, since the tray is pressed by the pressing roller from an upper part when the end of the tray reaches the ejecting driving roller, the end of the tray abuts on (collides with) the ejecting driving roller. That is, an uneasy "hooked feeling" is caused when the tray is inserted.

Further, since the tray is pressed by the pressing roller until the end of the tray reaches the ejecting driving roller, the pressing force thereof is exerted on the tray guide so that there is a fear that the position of the tray guide is changed from an adequate horizontal position to an inadequate inclined position.

SUMMARY

It is therefore an object of the invention to smoothly insert a tray without hooking the tray and give no adverse influence to the position of a tray guide when the tray is inserted into an inner part of a printer from an upper part of a guide unit in a structure including the guide unit for supporting the tray, a driving roller coming into contact with the bottom surface of the tray and a pressing roller arranged between the guide unit and the driving roller to press the tray toward the driving roller from an upper part.

In order to achieve the object, according to the invention, there is provided a transport system comprising:

a guide, operable to guide a transported medium in a transport direction;

a driver, disposed at a downstream side of the guide in the transport direction, and operable to come into contact with a bottom surface of the transported medium;

a presser, disposed between the guide and the driver, and operable to be displaced between a pressing position where the presser presses an upper surface of the transported medium toward the driver and a non-pressing position where the presser is separated from the upper surface of the transported medium; and a changer, adapted to be engaged with the transported medium so as to displace the presser to the pressing position from the non-pressing position, Wherein a leading end of the transported medium reaches the driver before or at a time when the presser presses the transported medium.

With this configuration, under a state that the transported medium is pressed by the presser, the leading end of the transported medium does not abut on the driver, so that the generation of a "hooked feeling" when the transported medium is inserted can be prevented or a degree thereof can be greatly reduced.

Since the pressing force of the presser for pressing the transported medium is not directly transmitted to the guide, an adverse influence is not given to the position of the guide and a position when the guide supports the transported medium can be maintained in an adequate state and the strength of the guide does not need to be assuredly set to a level not lower than a required value by considering the pressing force received from the presser. Thus, the cost of the guide can be lowered.

The "transported medium" means a broad concept including the medium on which, for instance, information (data) is recorded by the recording device, and also includes a medium (for instance, a tray on which the optical disk can be set, or the like) that is not directly recorded by the recording device, however, is transported in the recording apparatus.

The transported medium may be formed with a recessed portion in which a thin plate shaped medium is set.

The transport system may further includes a transport path, in which the transported medium is transported; and a follower, supported by a support member so as to be displaced between a contact position where the follower comes into contact with the driver so as to be driven by the driver and a separate position where the follower is separated from the driver. The changer may include a release member, rotatably supported by the support member and having a lever projecting to the transport path, and the lever may be pushed up by the transported medium so as to rotate the release member, so that the follower is displaced to the separate position from the contact position while the presser is displaced to the pressing position from the non-pressing position.

According to the invention, there is provided a recording apparatus incorporating the above transport system, comprising:

a recording apparatus, disposed at a downstream side of the driver in the transport direction, and operable to record information on a medium including the transported medium.

According to the invention, there is provided a liquid ejecting apparatus incorporating the above transport system, comprising:

a liquid ejecting device, disposed at a downstream side of the driver in the transport direction, and operable to eject liquid toward a medium including the transported medium.

In order to achieve the object, according to the invention, there is provided a transport system comprising:

a stacker, operable to be displaced between a first position where the is stacker forms a part of a transport path in which a first medium is transported in a first direction and a second position where the stacker receives a second medium having transported from a downstream side of the stacker in the first direction, and operable to perform a pivot movement, the second position located below the first position; and a changer, operable to change a position of the stacker, and including:

a first member, passing through the stacker in a second direction perpendicular to the first direction;

a second member, operable to guide the first member in a third direction perpendicular to the second direction;

a first regulator, disposed at an upstream side of the first member in the first direction, and operable to regulate the pivot movement so as to retain the stacker at the first position together with the first member and to retain the stacker in an upwardly inclined manner together with the first member after regulation of the first position is released or before the position of the stacker is changed to the first position;

a second regulator, disposed at a downstream side of the first member in the first direction, and operable to regulate the pivot movement so as retain the stacker at the second position together with the first member and to retain the stacker in an upwardly inclined manner together with the first member before the position of the stacker is changed to the second position or after regulation of the second position is released, wherein when the first member is displaced downwardly in a state that the stacker is disposed at the first position, a state in which the stacker is regulated by the first member and the first regulator is changed to a state in which the stacker is regulated by the first member and the second regulator, and when the first member is displaced upwardly in a state that the stacker is disposed at the second position, a state in which the stacker is regulated by the first member and the second regulator is changed to a state in which the stacker is regulated by the first member and the first regulator.

According to the invention, there is provided a recording apparatus incorporating the above transport system, comprising:

a recording apparatus, disposed at a downstream section in the first direction, and operable to record information on the first medium and the second medium.

According to the invention, there is provided a liquid ejecting apparatus incorporating the above transport system, comprising:

a liquid ejecting device, disposed at a downstream section in the first direction, and operable to eject liquid toward the first medium and the second medium.

DETAIL DESCRIPTION OF PREFERRED EMBODIMENTS

Figure 1:
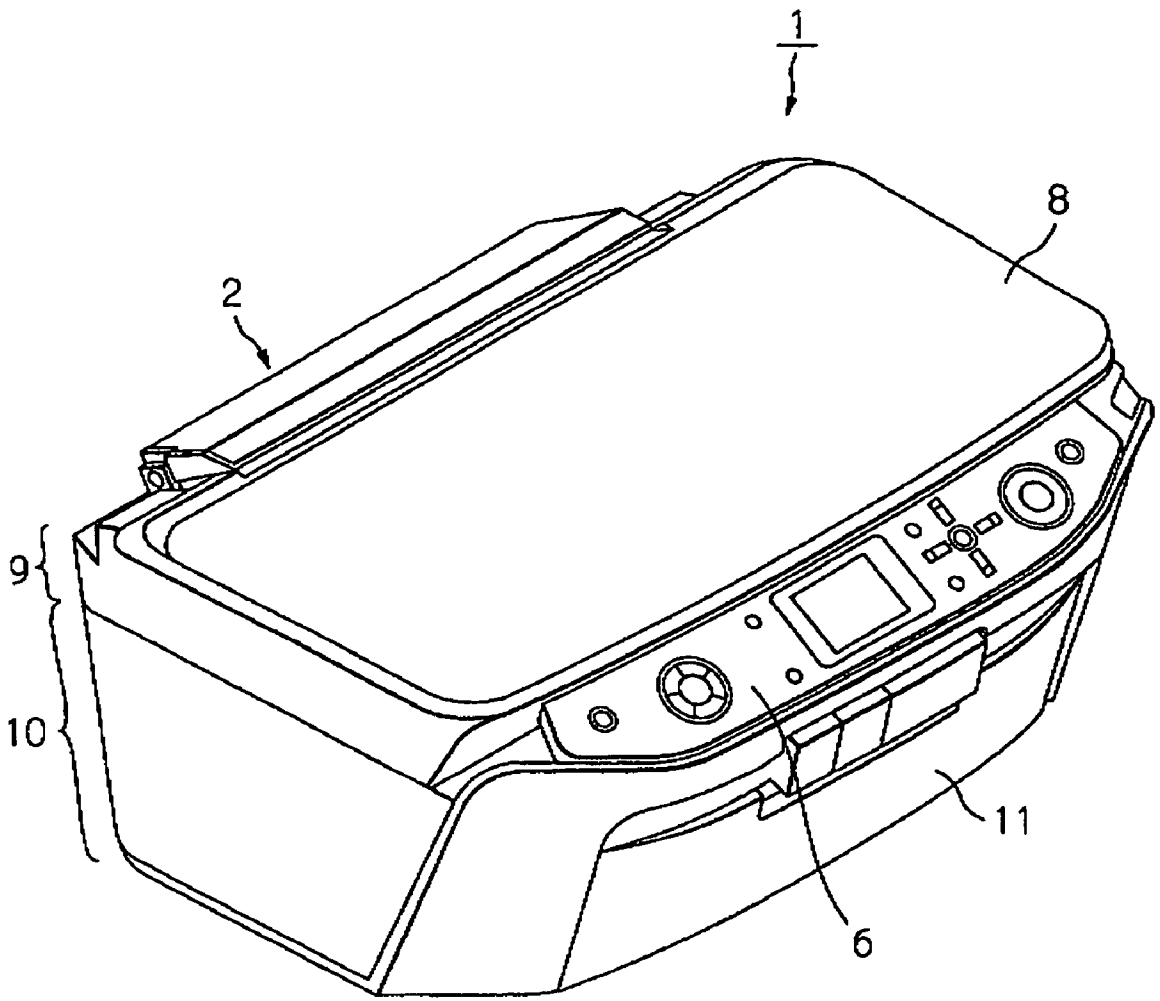
FIG. 1 is a perspective view of an external appearance of a printer according to the present invention.

Now, an embodiment of the present invention will be described in order as described below by referring to the drawings.

1. Entire structure of printer

2. Structure of position changing unit

3. Structure of tray

4. Structures of urging device and roller position changing unit

5. Positional relation between ejecting driving roller, pressing roller and tray <<1. Entire Structure of Printer>>

Now, referring to FIGS. 1 and 2, an entire structure of an ink jet printer (refer it to as a "printer", hereinafter) 1 will be generally described as an example of a recording apparatus or a liquid ejection apparatus according to the present invention. A rightward direction (a front side of the device) in FIG. 2 is referred to as a "downstream side" and a leftward direction (a rear side of the device) is referred to as an "upstream side", hereinafter.

Figure 2:
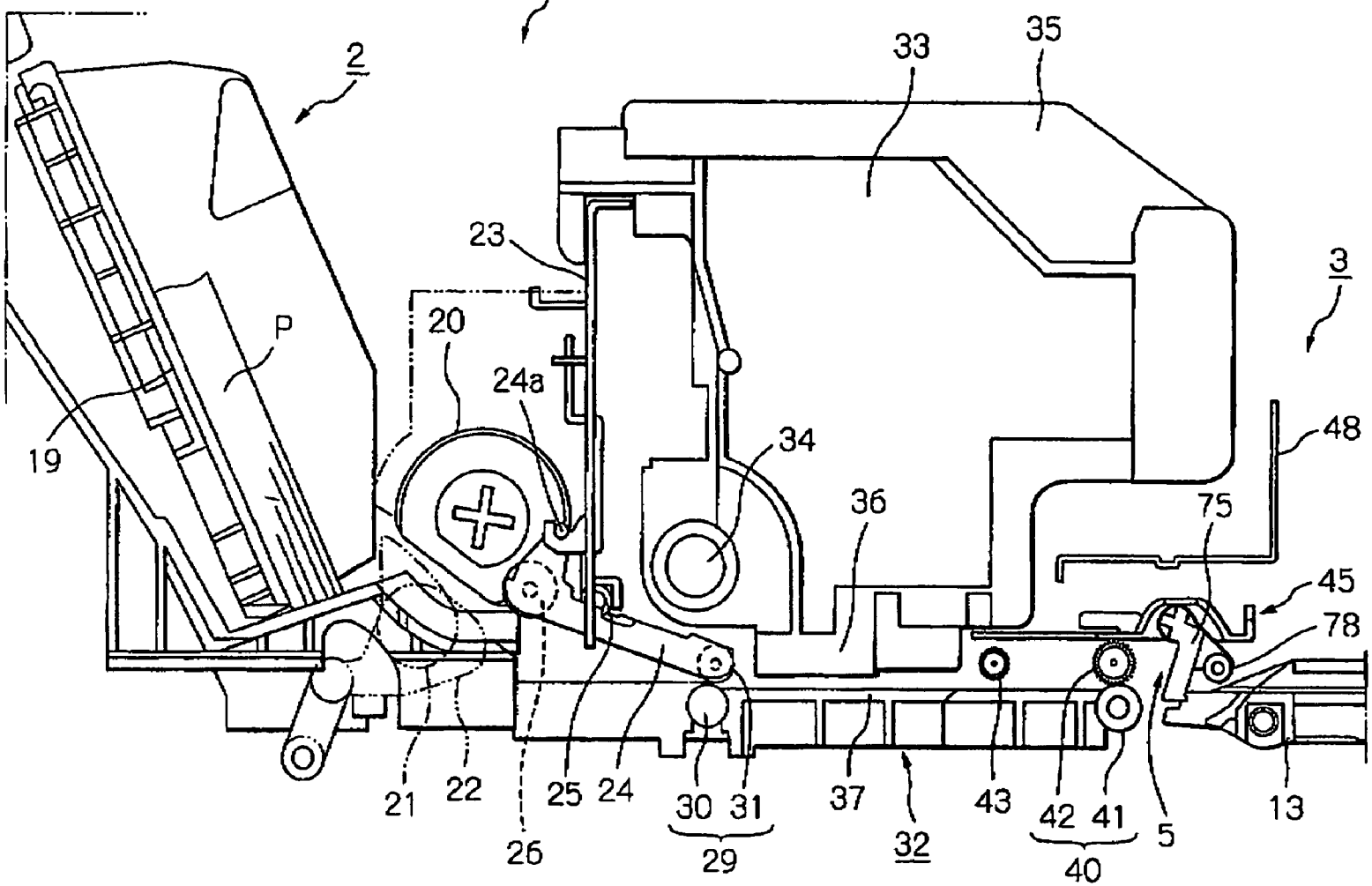
FIG. 2 is a side sectional view of the printer according to the present invention.

As shown in FIG. 1, the printer 1 is a compound machine having a scanner function as well as a printer function and includes a printer part 10 and a scanner unit 9 located in the upper part of the printer part 10.

The printer part 10 mainly includes a function of an ink jet type printer for performing an ink recording on a recording sheet (mainly, a cut-form sheet: refer it to as a "sheet P", hereinafter) as one example of a recorded medium, an ejected medium. In FIG. 1, a member designated by reference numeral 11 shows a cover member for covering an ejection port for ejecting the sheet P on which the recording is carried out. The cover member 11 opens the ejection port under a state that the cover member pivots by about 90° toward a front side when the printer function is employed. In the front side of the upper part of the printer part 10, an operating panel 6 is provided. In the operating panel 6, functions including a scanning function using the scanner unit 9, a recording function in the printer part 10 and a function for recording a scanned image can be realized.

The scanner unit 9 includes a cover member 8 that can be opened and closed by pivoting upward on a shaft not shown in the drawing (provided in a rear side). On the lower side of the cover member 8, a glass mount surface (not illustrated) on which a printed material as an object when a scanning operation is carried out is mounted. Further, in the lower side of the glass mount surface, a scanning device (not shown in the drawing) is provided. The scanner unit 9 itself entirely pivots upward on the shaft not shown in the drawing (provided in the rear side) so that the upper part of the printer part 10 is opened to perform an exchange of a member (for instance, an ink cartridge) or a maintenance in a recording part such as a carriage.

Now, referring to FIG. 2, the structure of the printer part 10 will be described below. The printer part 10 roughly has the structure in which the sheet P is fed to a transport roller 29 as a transport unit of the recorded medium from a feeder 2 provided in the rear part of the device, the sheet P is transported to a recording unit 32 by the transport roller 29 and the sheet P on which the recording is carried out is ejected outside the device by an ejecting device 3 of the recorded medium. Further, the printer has a linear transport path that can transport a tray 90 (FIG. 14) having a plate form on which an optical disk as the recorded medium is set or a transported medium having a high rigidity such as a thick board sheet by the transport roller 29. That is, the printer part is formed in such a way that the ink recording can be directly realized on the label surface of the optical disk or the board sheet.

Now, a detailed explanation of the structure will be given firstly from the feeder 2. The feeder 2 includes a hopper 19, a feed roller 20, a retard roller 21 and a return lever 22.

The hopper 19 is formed with a plate shaped member to swing on an upper supporting point (not illustrated) of a swing action operation. The hopper 19 swings to press the sheet P supported on the hopper 19 in an inclined position in contact with the feed roller 20 or separate the sheet P from the feed roller 20. The feed roller 20 has substantially a D shape in side view to feed the sheet P on an uppermost part that is pressed in contact by its circular arc part to the downstream side. After the sheet P is fed, during transporting the sheet P by the transport roller 29, the feed roller 20 is controlled so that its flat part is opposed to the sheet P not to generate a transport load as shown in the drawing.

The retard roller 21 is provided so as to come into contact with the circular arc part of the feed roller 20. When the overlap feed of the sheets P is not generated and only one sheet P is fed, the retard roller 21 is driven and rotated (clockwise in FIG. 2) in contact with the sheet P. When a plurality of sheets P are present between the feed roller 20 and the retard roller 21, since a coefficient of friction between the sheets is lower than a coefficient of friction between the sheet P and the retard roller 21, the retard roller 21 does not rotate and stops. Accordingly, the subsequent sheets P including the sheet just below the uppermost sheet P to be fed that are liable to be overlap fed following the uppermost sheet P do not move to the downstream side from the retard roller 21 to prevent the overlap feed. The return lever 22 is provided so as to freely pivot and serves to return the subsequent sheets P including the sheet just below the uppermost sheet that are liable to be overlap fed to the hopper 19.

Between the feeder 2 and the transport roller 29, provided are a detecting unit (not shown in the drawing) for detecting the passage of the sheet P and a guide roller 26 for forming a feeding position of the sheet P, preventing the sheet P from coming into contact with the feed roller 20 and reducing the transport load.

Figure 3:
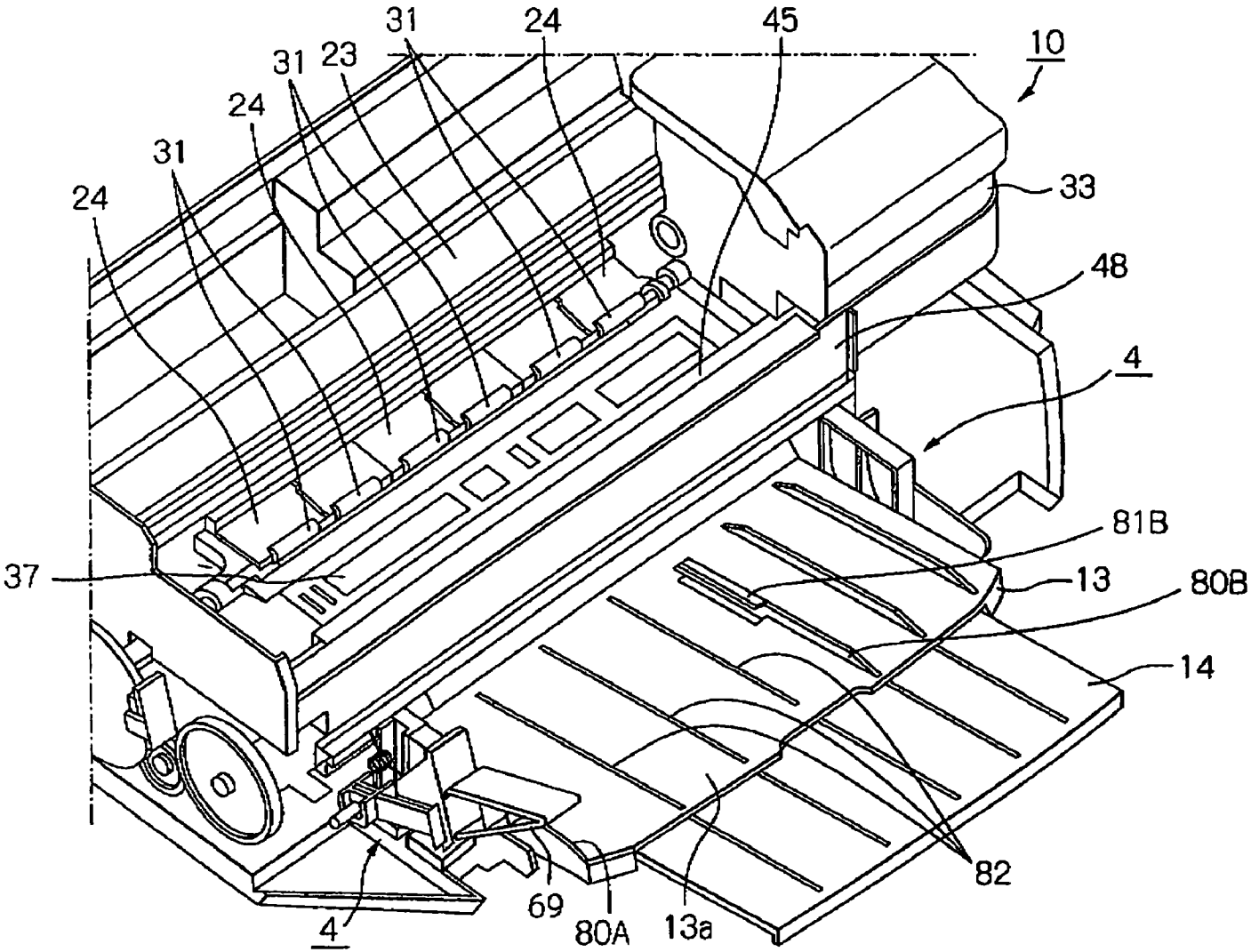
FIG. 3 is a perspective view of an external appearance of a device main body of the printer according to the present invention.

The transport roller 29 provided in the downstream side of the feeder 2 includes a transport driving roller 30 rotated and driven by a motor and a transport follower roller 31 driven and rotated in contact with the transport driving roller 30. The transport driving roller 30 is formed with an adhering layer in which abrasion resistant particles are substantially uniformly dispersed on the outer peripheral surface of a metal shaft extending in the direction of width of the sheet. The transport follower roller 31 has an outer peripheral surface made of a low frictional material such as elastomer. As shown in FIG. 3, a plurality of transport follower rollers 31 are arranged in the axial direction of the transport driving roller 30.

Further, in this embodiment, the two transport follower rollers 31 are supported to freely rotate in end parts in the downstream side on one upper sheet guide 24. The three upper sheet guides 24 are provided in the direction of width of the sheet as shown in FIG. 3. Further, a shaft 24*a* is supported by a main frame 23 so that the upper sheet guide 24 can swing on the shaft 24*a* on the sheet transport path in a side view. The transport follower roller 31 is urged to be pressed to the transport driving roller 30 by a coil spring 25.

Under a state that the sheet P fed to the transport roller 29 by the feeder 2, the tray 90 (FIG. 14) inserted from the front side of the device or the board sheet is nipped between the transport driving roller 30 and the transport follower roller 31, the transport driving roller rotates so that the sheet P or the like is transported to the recording unit 32 in the downstream side.

The recording unit 32 includes an ink jet recording head (refer it to as a "recording head", hereinafter) 36 and a lower sheet guide 37 provided so as to be opposed to the recording head 36. The recording head 36 is provided in the bottom part of a carriage 33. The carriage 33 is guided by a carriage guide shaft 34 extending in a main scanning direction and driven so as to reciprocate in the main scanning direction by a driving motor not shown in the drawing. Further, the carriage 33 includes independent ink cartridges (not illustrated) respectively for a plurality of colors in a cover 35 to supply ink to the recording head 36 from the ink cartridges.

On the lower sheet guide 37 for providing a distance between the sheet P and the recording head 36, ribs are formed (not shown in the drawing) on a surface opposed to the recording head 36 and a recessed part (not shown in the drawing) for discarding ink is formed. The ink discarded to an area located outside the end part of the sheet P is discarded to the recessed part to perform what is called a frame-less printing in which a printing operation is carried out in the end part of the sheet P without a space.

In the downstream side of the recording head 36, the ejecting device 3 of the recorded medium is provided. The ejecting device 3 of the recorded medium includes a guide roller 43, an ejecting roller 40, a sheet ejection frame Assy 45, a stacker 13, a frame 48, a roller position changing unit 5 and other components not shown in FIG. 2.

The guide roller 43 serves to prevent the sheet P from floating from the lower sheet guide 37 and maintain the distance between the sheet P and the recording head 36 to a prescribed value. The ejecting roller 40 includes an ejecting driving roller 41 rotated and driven by a motor that is not shown in the drawing and an ejecting follower roller 42 driven and rotated in contact with the ejecting driving roller 41. In this embodiment, the ejecting driving roller 41 is made of a rubber roller and a plurality of ejecting driving rollers are provided in the axial direction of a rotated and driven shaft member.

The ejecting follower roller 42 is formed with a spur roller having a plurality of teeth on its outer periphery. A plurality of ejecting follower rollers are provided on the sheet ejection frame Assy 45 so as to be paired with a plurality of ejecting driving rollers 41. Under a state that the sheet P on which a recording is carried out by the recording unit 32 is nipped by the ejecting driving roller 41 and the ejecting follower roller 42, when the ejecting driving roller 41 is rotated and driven, the sheet is ejected to the stacker 13. Though a detail is described below, under a state that the tray 90 (FIG. 14) or the board sheet is nipped by the ejecting driving roller 41 and a pressing roller 78, when the ejecting driving roller 41 is rotated and driven, the tray or the like is ejected to the downstream side.

The sheet ejection frame Assy 45 is provided so as to be displaced (switched) to a contact position where the ejecting follower roller 42 comes into contact with the ejecting driving roller 41 and a separate position where the ejecting follower roller 42 is separated from the ejecting driving roller 41. Further, the roller position changing unit 6 is provided for displacing the sheet ejection frame Assy 45 from the contact position to the separate position. The above-described things will be described below in detail.

In the downstream side of the sheet ejection frame Assy 45, the stacker 13 is provided for staking the ejected sheets P. The stacker 13 is provided so as to be changed to a first position (see FIG. 2 and FIG. 4B) for forming the linear transport path for transporting the tray 90 (FIG. 14) or the board described below in detail and a second position (see FIG. 4A) located below the first position to stack the sheets P ejected by the ejecting roller 40 by the position changing unit 5 (described below). The tray 90 or the board sheet having the plate form is supported by the stacker 13 and manually inserted (fed) to the rear side (the upstream side) from the front part of the device when the stacker 13 is located in the first position. That is, the stacker 13 also functions as a guide unit for supporting the tray 90.

The printer 1 has the entire structure as described above.

<<2. Structure of Position Changing Unit>>

Now, referring to FIGS. 3 to 13, the position changing unit 4 for changing the position of the stacker 13 will be described in detail.

As shown in FIG. 3, in the stacker 13 provided in the front part of the device, a sub-stacker 14 is accommodated. When the sub-stacker 14 is pulled out from the stacker 13, a support surface (a stack surface) for supporting the sheet P is extended. FIG. 3 shows a state that the stacker 13 is located in the second position. When the stacker 13 is located in the first position, that is, when the stacker is in a position for guiding the tray 90 (FIG. 14) or the board sheet, the sub-stacker 14 is accommodated in the stacker 13.

On the support surface 13*a* of the stacker 13, as shown in FIGS. 3 to 6, guide ribs 80A and 80B for guiding both the side ends of the tray 90 (FIG. 14) are formed. Further, on the guide ribs 80A and 80B, roof parts 81A and 81B having forms for covering the upper parts of both the side ends of the tray 90 are respectively formed. When the tray 90 is inserted into the printer 1 from the upper part of the stacker 13 located in the first position, the position of the tray 90 in the main scanning direction is regulated by the guide ribs 80A and 80B. The tray 90 is regulated not to float from the support surface 13*a* by the roof parts 81A and 81B. Further, on the support surface 13*a*, to decrease a contact area between the support surface 13*a* and the bottom surface of the tray 90 and smoothly guide the tray 90, a plurality of ribs 82 extending in the inserting direction of the tray 90 are formed at suitable intervals in the direction of width of the tray 90.

Figure 4A:
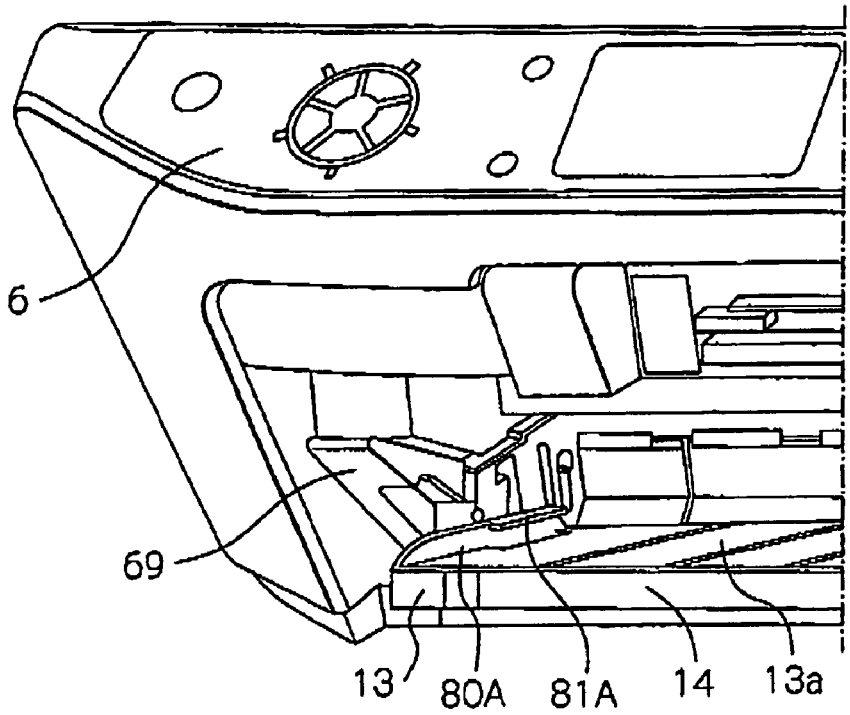
FIGS. 4A and 4B are perspective views of an external appearance of a front part of the printer according to the present invention.
Figure 4B:
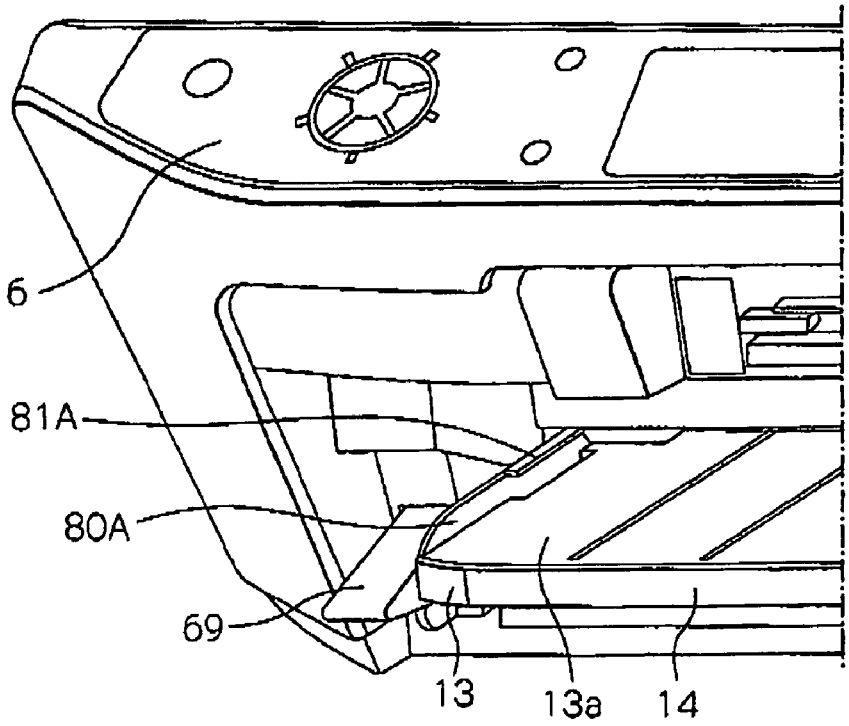

In both the sides of the stacker 13, the position changing units 4 are provided. The left side position changing unit 4 is provided with an operating lever 69. As shown in FIG. 3 and FIG. 4A, the operating lever 69 is located in a position directed slightly upward when the stacker 13 is located in the second position. When the operating lever 69 is pushed downward, the position changing unit 4 operates so that the position of the stacker 13 is changed (displaced) to the first position as shown in FIG. 4*d*.

Figure 6:
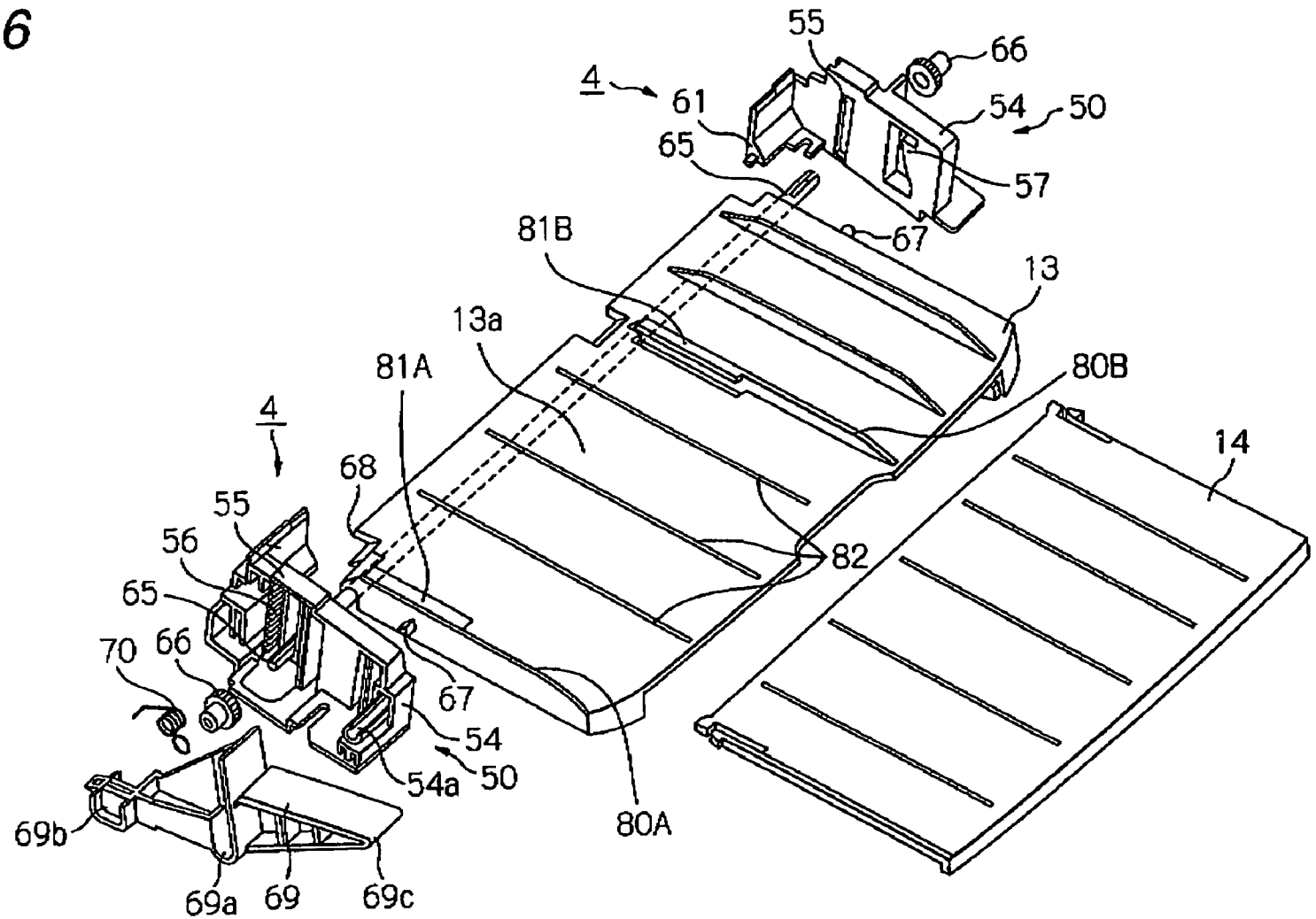
FIG. 6 is an exploded perspective view of the stacker and the position changing unit.
Figure 7:
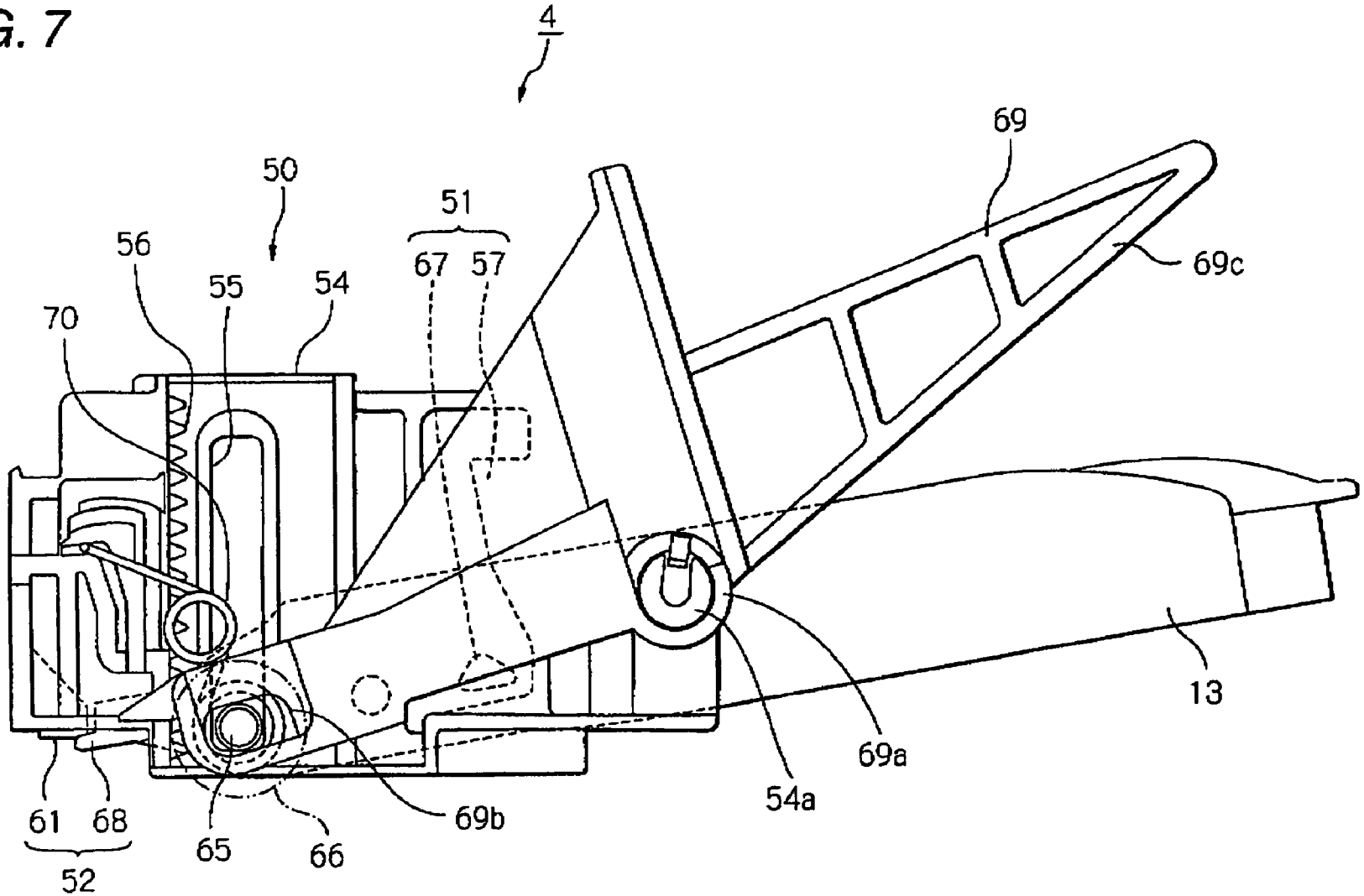
FIG. 7 is a side view of the stacker and the position changing unit.
Figure 8:
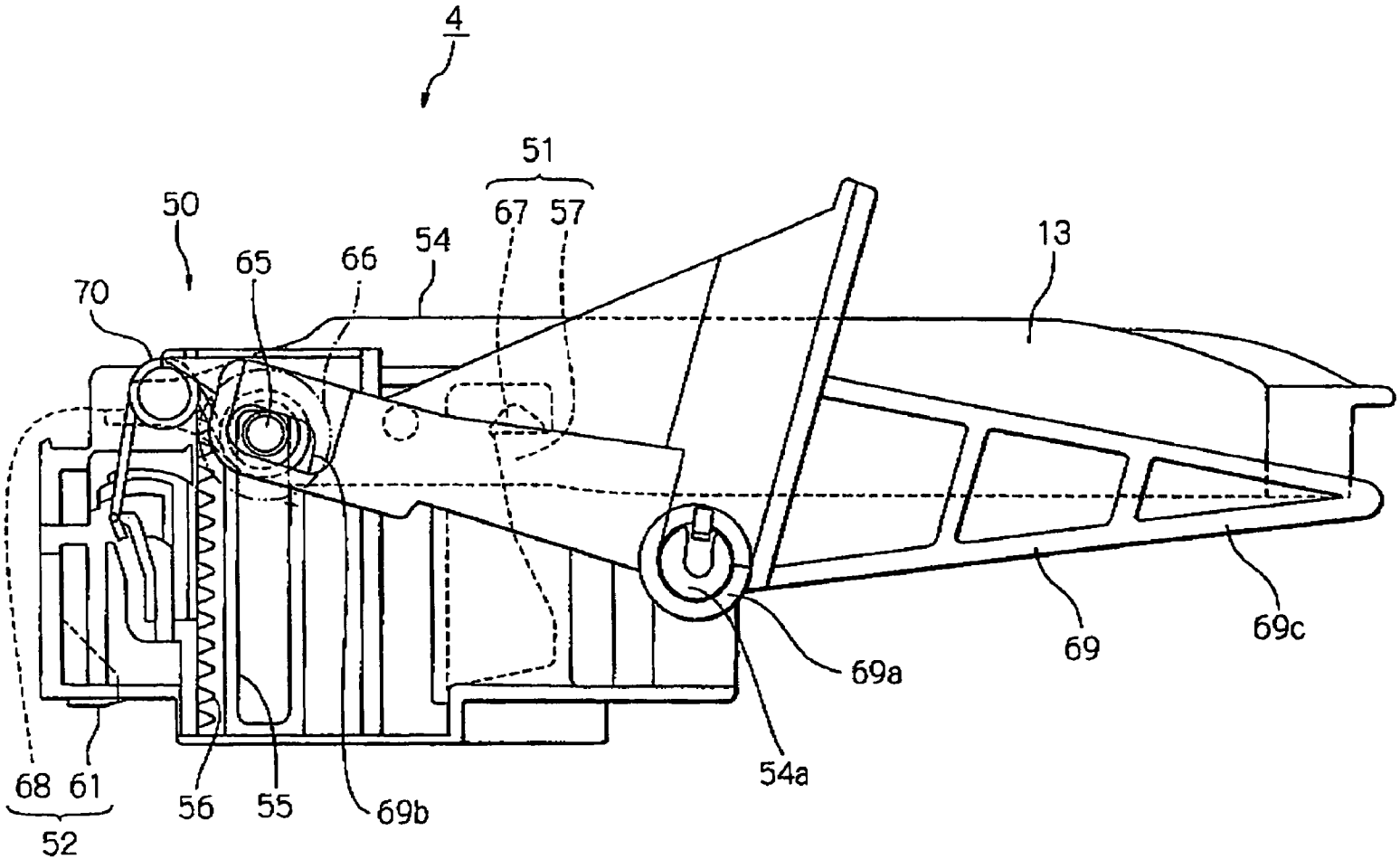
FIG. 8 is a side view of the stacker and the position changing unit.

As shown in FIGS. 7 and 8, the operating lever 69 includes a bearing part 69*a* and an operating part 69*c* extending to the front side of the device (rightward in the drawing) from the bearing part 69*a*. Further, a slot 69*b* is formed at an end part of a side extending inward (leftward in the drawing) of the device from the bearing part 69*a*. The bearing part 69*a* is fitted to a shaft 54*a* formed in a below-described guide member 54. Thus, operating lever 69 freely pivots on the shaft 54*a*. In FIGS. 5 to 8, reference numeral 70 designates a two-stable spring for urging the operating lever 69. The operating lever 69 is held either at a position shown in FIG. 7 or at a position shown in FIG. 8 in a stable way by the two-stable spring 70.

Figure 10A:
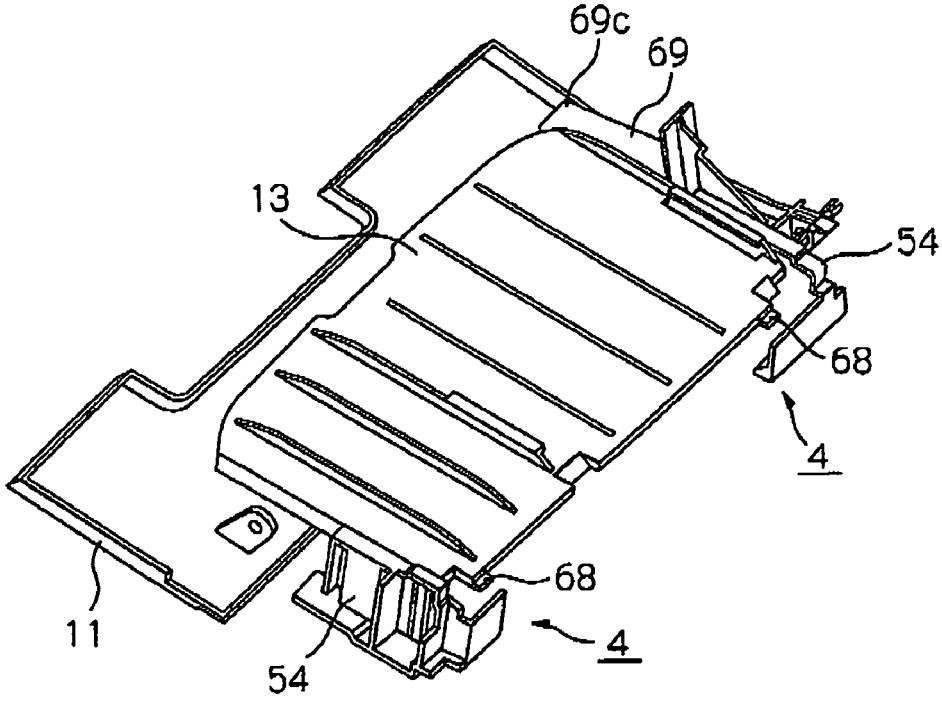
FIGS. 10A and 10B are perspective views of the stacker, the position changing unit and a cover.
Figure 10B:
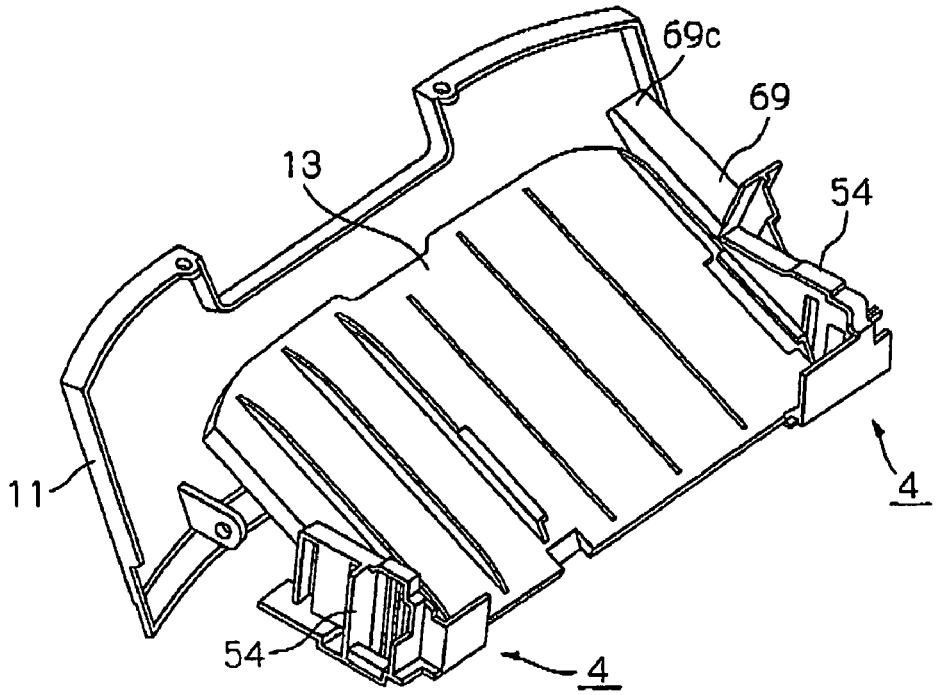

As shown in FIGS. 10A and 10B, in the operating lever 69, the operating part 69*c* can be engaged with the cover member 11 provided below the stacker 13. FIG. 10A shows a state that the stacker 13 is located in the first position. The length of the operating part 69*c* and the positional relation are set so that when the cover member 11 is pivoted to a closing direction from this state, the cover member 11 pivots the operating lever 69 so as to change the stacker 13 from the first position to the second position (pushed up) as shown in FIG. 10B.

In addition thereto, under both conditions that the stacker 13 is located in the first position and the second position, even when a free end thereof interferes with the cover member 11 as the cover member 11 is pivoted in the closing direction, the stacker 13 can freely pivot (semi-restrained) so that the free end is pushed upward in accordance with the pivot operation of the cover member 11.

Accordingly, as described above, when the stacker 13 is located in the first position, if the cover member 11 is pivoted in the closing direction, the cover member 11 pushes up the operating lever 69. Thus, only an operation for pivoting the cover member 11 in the closing direction makes it possible to change the position of the stacker 13 to the second position and pivot the stacker 13 (FIG. 10B).

Further, even when the cover member 11 interfered with the stacker 13 as the cover member 11 pivots, since the stacker 13 is in a semi-restrained state so that the stacker 13 can freely pivot to push up the free end, there is no fear that the stacker 13 is broken by the cover member 11.

Figure 5:
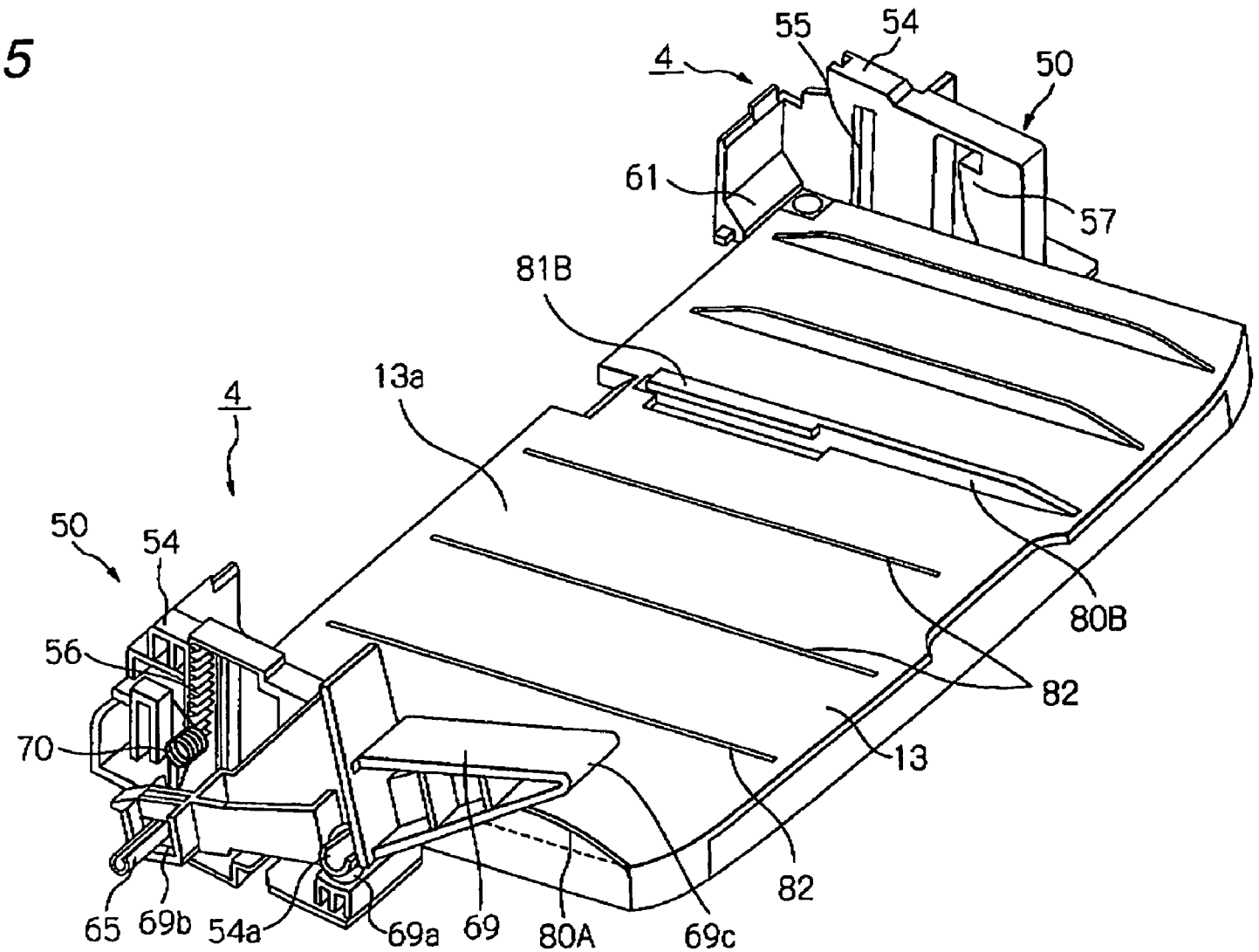
FIG. 5 is a perspective view of a stacker and a position changing unit.

The position changing unit 4 includes one shaft 65 and a guide unit 50 as shown in FIGS. 5 and 6. Further, as shown in FIGS. 8 to 9B, though not shown in FIGS. 5 and 6, the position changing unit 4 includes a first regulating unit 51 located in the free end side of the stacker 13 with respect to the shaft 65 and a second regulating unit 52 located in the base end side of the stacker 13 with respect to the shaft 65.

Figure 9A:
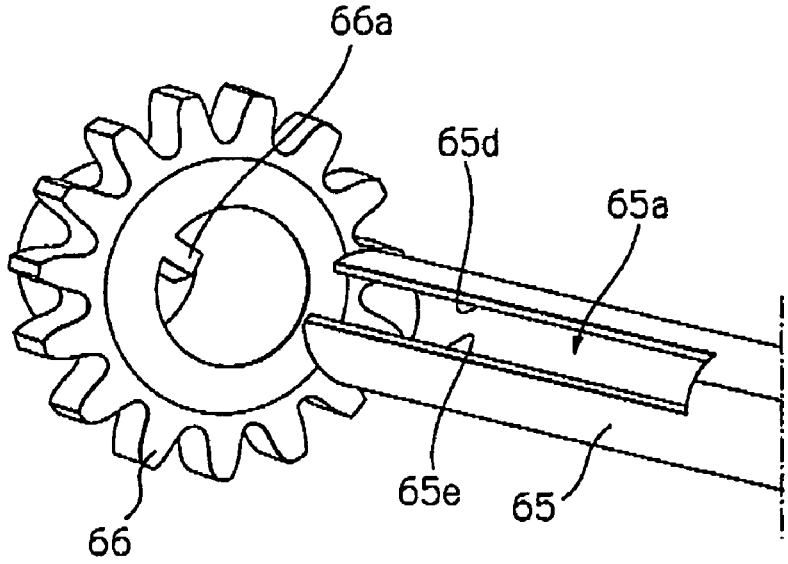
FIGS. 9A and 9B are perspective views of a shaft member and a pinion gear.
Figure 9B:
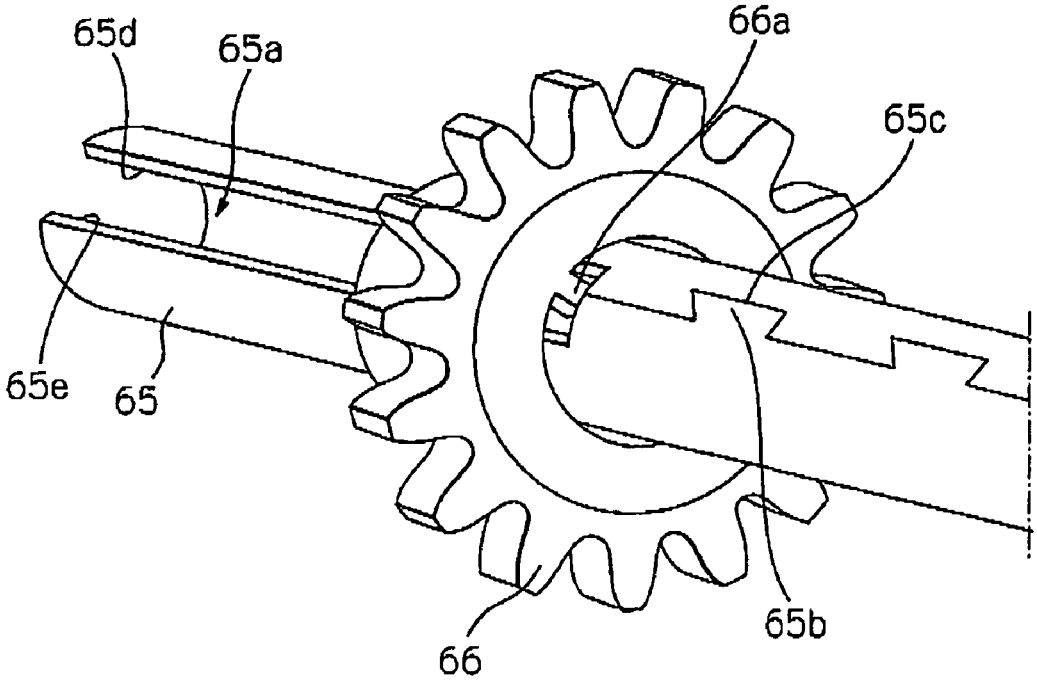

The shaft 65 is arranged nearer to the base end side of the stacker 13 (a left side in FIGS. 8 to 9B) than to the position of a center of gravity of the stacker 13 in a side view of the stacker 13 as shown in FIGS. 8 to 9B. The shaft 65 is extended in the direction of width of the stacker 13, inserted into the stacker 13 and freely rotates on the stacker 13 so as to protrude outside from both the side surfaces of the stacker 13.

The guide unit 50 includes a pinion gear 66 attached to the shaft end of the shaft 65 and the guide member 54 having a guide hole 55 extending in the displacing direction (upward and downward in this embodiment) of the stacker 13 and having an end part of the shaft 65 freely inserted and a rack 56 engaging with the pinion gear 66.

The guide members 54 are arranged on both the sides of the stacker 13 separately from and independently of a housing member forming the bottom part of the printer 1.

The shaft 65 is freely inserted into the guide hole 55 so that the shaft 65 is regulated to be displaced only upward and downward and one end thereof is freely inserted into the slot 69*b* formed in the operating lever 69. Accordingly, when the operating lever 69 is pivoted, the shaft 65 (the stacker 13) is displaced vertically in the guide hole 55 in accordance with the pivot of the operating lever 69.

The shaft 65 is constructed in such a way that the right and left parts thereof are synchronously displaced upward and downward by rack and pinion mechanisms (the rack 56 and the pinion gear 66) arranged at both the sides of the stacker 13. Thus, when the operating lever 69 is operated, an inconvenience is prevented that only one side is displaced vertically.

As shown in FIGS. 9A and 9B, in the shaft end of the shaft 65, a key hole 65*a* extending in the axial direction is formed. A protrusion 66*a* formed in the inner periphery of the pinion gear 66 is fitted to the key hole 65*a* so that the pinion gear 66 is provided in a fixed state so as not to slip relative to the shaft 65. Here, the shaft 65 is a hollow shaft formed by a bending work of a metal plate. A cylindrical form is maintained for a long time by a fit structure that a protruding part 65*b* and a recessed part 65*c* formed in the end part of a preprocessed metal plate material are fitted to each other.

The protruding part 65*b* has a width that is larger as it goes to its end. The recessed part 65*c* has a form just fitted to the protruding 65*b* formed in such a way. Since the above-described recessed part 65*c* and the protruding part 65*b* are fitted to each other to generate a wedge effect, a joint part is not opened by a spring back action of the metal plate and the form of the cylindrical shaft can be maintained for a long period without a joining process such as a welding process.

The key hole 65*a* is formed by performing a bending work to step parts 65*d* and 65*e* formed in the preprocessed metal plate material to allow the step parts to face each other. The joint of the cylindrical shaft is located substantially at the central part of the key hole 65*a*. Accordingly, since the key hole 65*a* is formed after the metal plate is bent, a cutting work is not separately carried out so that the key hole 65*a* can be easily and inexpensively formed. Further, the dimensions of width and length of the key hole 65*a* can be easily adjusted.

As shown in FIGS. 6 to 8, in the side surface of the stacker 13, a first engaging part 67 is formed that has a triangular shape in a front view and protrudes to the guide member 54. Further, in the end part of the base end side of the stacker 13, a second engaging part 68 is formed that protrudes inward of the device. On the other hand, in the side of the guide member 54, a first regulating part 57 on which the first engaging part 67 abuts and a second regulating part 61 on which the second engaging part 68 abuts are formed. The first engaging part 67 and the first regulating part 57 form the first regulating unit 51 and the second engaging part 68 and the second regulating part 61 form the second regulating unit 52.

Figure 11A:
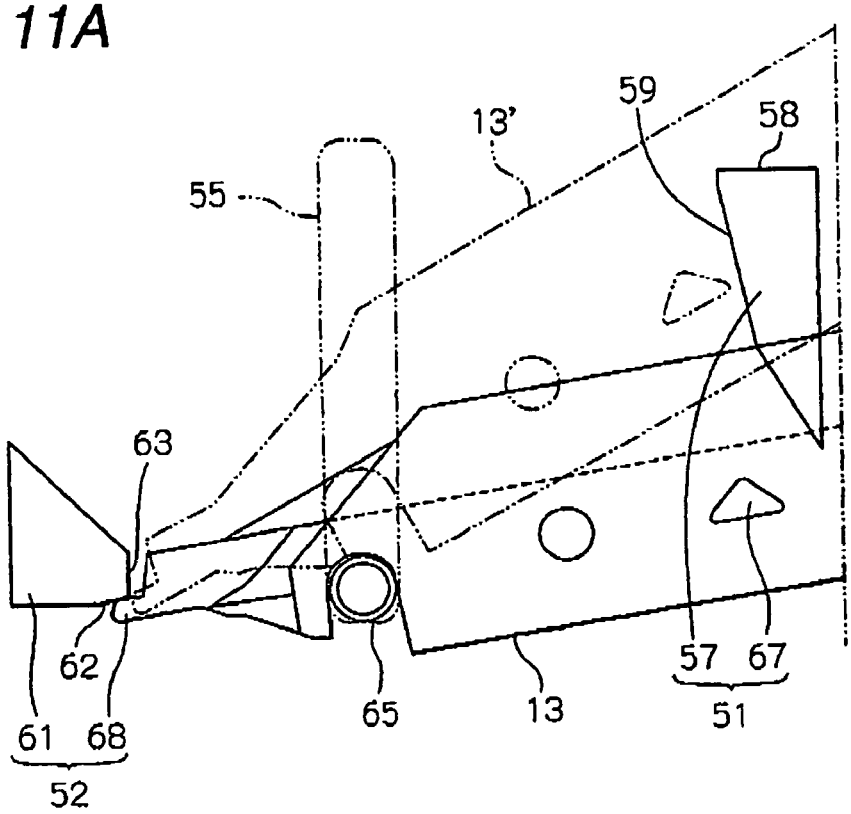
FIGS. 11A and 11B are side views of main parts of the position changing unit.
Figure 11B:
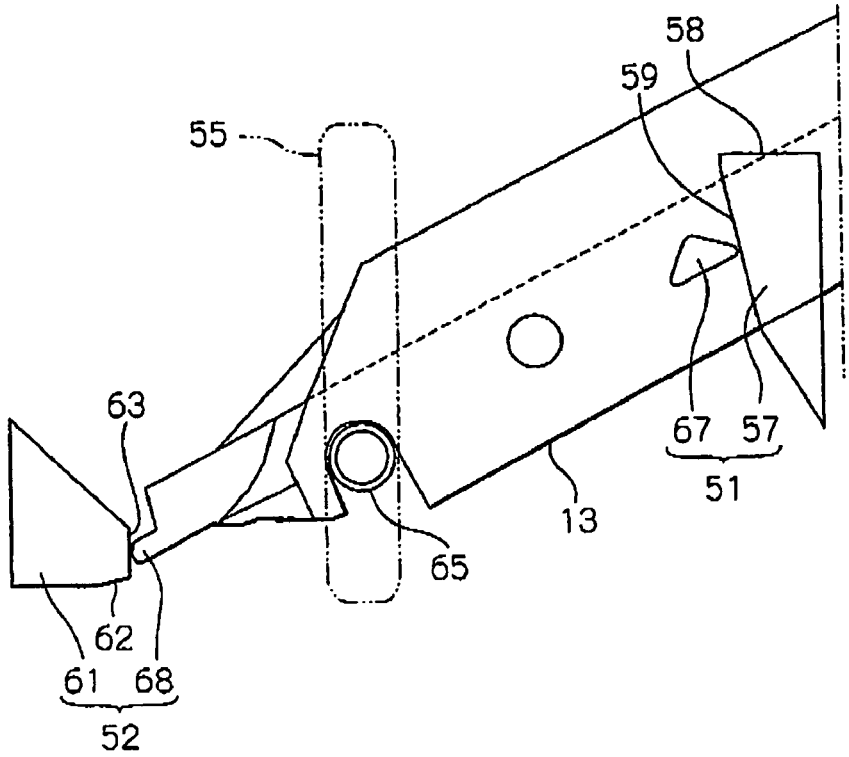

Now, the first regulating unit 51 and the second regulating unit 52 formed as mentioned above will be described below in more detail. As shown in FIG. 11A, the first regulating part 57 includes a first regulating surface 58 having a substantially horizontal plane and a second regulating surface 59 having an inclined surface extending downward and separating from the first engaging part 67. Further, the second regulating part 61 includes a third regulating surface 62 forming a part of the bottom surface of the second regulating part 61 and a fourth regulating surface 63 forming a substantially vertical surface, extending upward and forming an inclined surface separating from the second engaging part. In FIGS. 11A to 13, the first regulating part 57 and the second regulating part 61 that are actually formed in the guide member 54 are shown by a full line as independent members for the purpose of simplifying the drawings.

When the stacker 13 is located in the second position, as shown by the full line in FIG. 7 or FIG. 11A, the shaft 65 is pressed to come into contact with the lower edge of the guide hole 55 by the self-weight of the stacker 13 and the second engaging part 68 enters the lower side of the second regulating part 61 to abut on the third regulating surface 62. That is, since the shaft 65 is located in the base end side with respect to the position of a center of gravity of the stacker 13, the stacker 13 is apt to pivot clockwise on the shaft 65 in the drawing. However, the second engaging part 68 abuts on the third regulating surface 62 so that the pivot operation is regulated. Thus, the second position of the stacker 13 is held. In this second position, the first engaging part 67 is not engaged with the first regulating part 57 and is separated therefrom. In the second position, the stacker 13 is located in the inclined position where the free end side is directed slightly upward as shown in the drawing.

Then, the operating lever 69 is pressed downward from a state that the stacker 13 is located in the second position. That is, when the shaft 65 is displaced upward in the guide hole 55, as shown by a virtual line and reference numeral 13' in FIG. 11A, the second engaging part 68 moves to an end part of the third regulating surface 62 and the free end of the stacker 13 is pushed upward. Then, when the operating lever 69 is further pressed downward to displace the shaft 65 upward, as shown in FIG. 118, the second engaging part 68 moves to the fourth regulating surface 63 from the third regulating surface 62. After that, the second engaging part 68 abuts on the fourth regulating surface 63 and is displaced upward. In a series of processes, since the first engaging part 67 maintains the state that the first engaging part is separated from the first regulating part 57, the inclined position of the stacker 13 is formed by the second regulating unit 52 and the shaft 65.

Figure 12A:
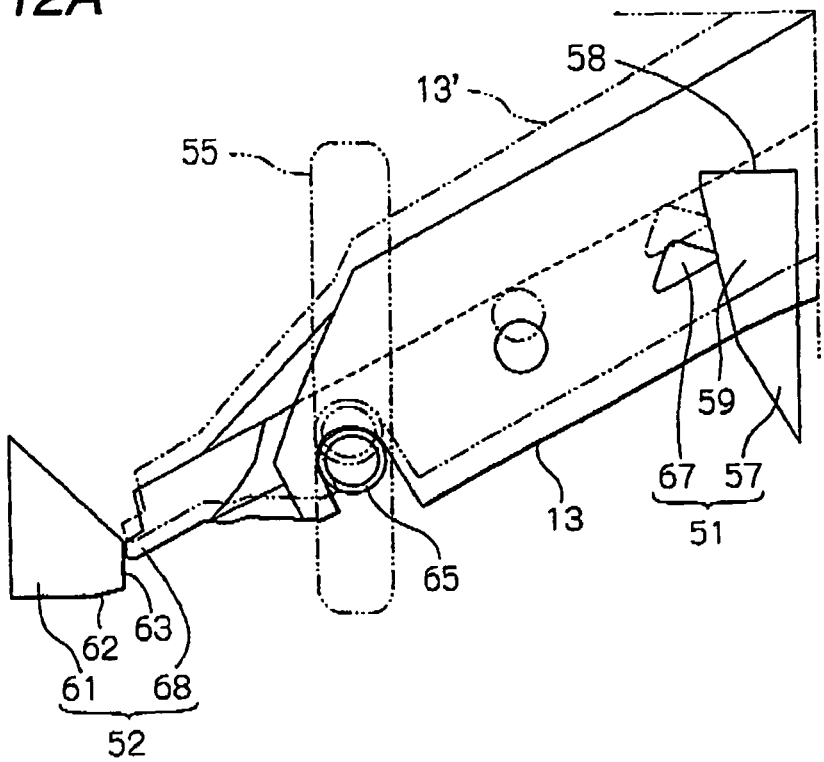
FIGS. 12A and 12B are side views of main parts of the position changing unit.

Subsequently, when the operating lever 69 is further pressed downward to displace the shaft 65 upward, as shown by a change from a virtual line to a full line in FIG. 12A, the second engaging part 68 is separated from the fourth regulating surface 63 and the first engaging part 67 abuts on the second regulating surface 59. After that, the first engaging part 67 abuts on the second regulating surface 59 and is displaced upward. Thus, the pivot operation of the stacker 13 is regulated. That is, a unit for forming the position of the stacker 13 shifts from the second regulating unit 52 to the first regulating unit 51.

Figure 12B:
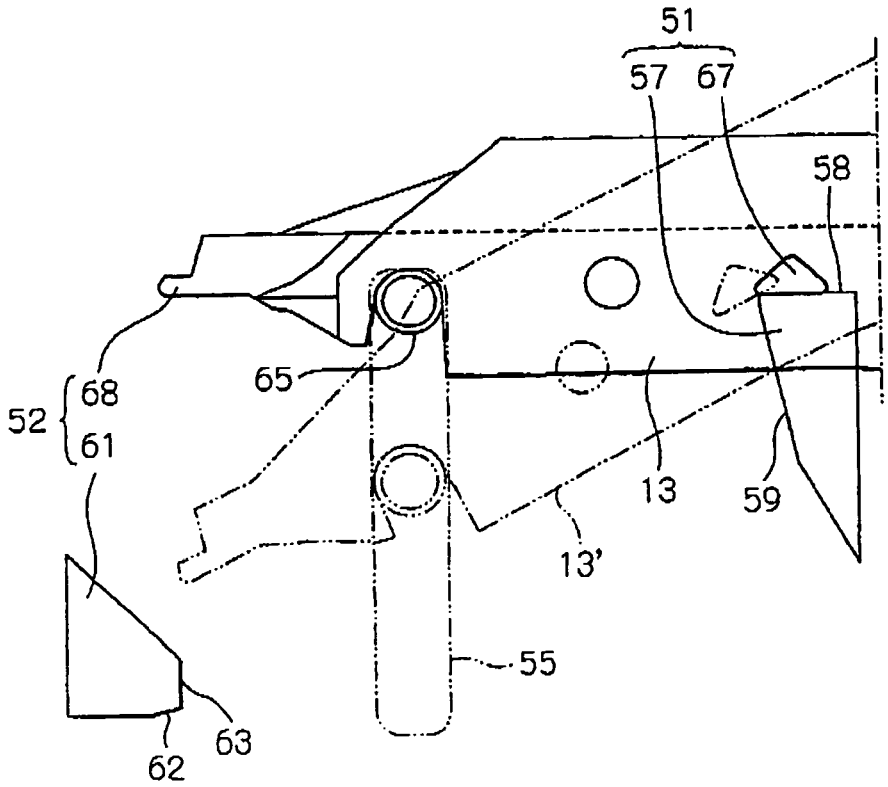

Then, when the operating lever 69 is further pressed downward to displace the shaft 65 more upward, as shown by a change from a virtual line to a full line in FIG. 12B, the first engaging part 67 changes from an abutting state on the second regulating surface 59 to an abutting state on the first regulating surface 58. Thus, the position of the stacker 13 is changed from an inclined position to a substantially horizontal position, and finally changed to the first position. In the first position, the first engaging part 67 is pressed to the first regulating surface 58 from an upper part by the self-weight of the stacker 13. Since the pressing and contact point is located nearer to the base end side than to the center of gravity of the stacker 13, the stacker 13 is apt to pivot clockwise in the drawing. However, since the shaft 65 is pressed to the upper edge of the guide hole 55, the pivot operation of the stacker 13 is regulated. Thus, the first position is held.

When the first engaging part 67 abuts on the second regulating surface 59 and is displaced upward (a state shown by the virtual line in FIG. 12A), if an inclination angle of the stacker 13 is gentle, the first engaging part 67 cannot be strongly pressed to the second regulating surface 59, nor displaced upward. Thus, the inclination angle of the stacker 13 when the first engaging part 67 abuts on the second regulating surface 59 and is displaced upward is desirably steep as much as possible.

When the stacker 13 changed to the first position in such a way is switched to the second position again, the operating lever 69 is pressed upward in a manner opposite to the above-described manner to displace the shaft 65 downward. Thus, the state that the first engaging part 67 is pressed to the first regulating surface 58 from the upper part is changed to the state that the first engaging part 67 abuts the second regulating surface 59 from a side so that the first engaging part 67 abuts on the second regulating surface 59 and is displaced downward. Then, the first engaging part 67 is separated from the second regulating surface 59 and the second engaging part 68 abuts on the fourth regulating surface 63 from a side. Then, the second engaging part 68 abuts on the fourth regulating surface 63 and is displaced downward. Finally, the second engaging part 68 enters the lower side of the second regulating part 61. The second engaging part 68 abuts on the third regulating surface 62. Thus, the stacker 13 is changed to the second position.

As described above, the first regulating unit 51 holds the first position of the stacker 13. Further, the first regulating unit 51 regulates the position of the stacker 13 together with the shaft 65 to the inclined position (the inclined position in which the free end is directed upward) after the first position is released when the first position is switched to the second position or before the position is changed to the first position when the second position is changed to the first position. Further, the second regulating unit 52 holds the second position of the stacker 13. Further, the second regulating unit 52 regulates the position of the stacker 13 together with the shaft 65 to the inclined position (the inclined position in which the free end is directed upward) after the second position is released when the second position is switched to the first position, or before the position is switched to the second position when the first position is changed to the second position.

The position changing unit 4 formed as described above includes the two regulating units of the first regulating unit 51 and the second regulating units 52, that is, the two units for regulating the position of the stacker 13. In the processes of the position changing operation of the stacker 13, the position changing unit maintains the stacker 13 to the inclined position where the free end side is directed upward and alternately shifts a function for regulating the position of the stacker 13.

Accordingly, only a simple operation is carried out for moving the shaft 65, provided between the first regulating unit 51 and the second regulating unit 52, in the guide hole 56 upward and downward so that a position changing operation to both directions can be realized that the stacker 13 is changed from the first position to the second position, and from the second position to the first position. Further, the two regulating units are used so that the positions can be respectively assuredly held. Namely, the position changing operation of the stacker 13 can be only by operating the operating lever 69 upward and downward. Accordingly, the position changing operation of the stacker 13 can be made to be more understandable and simpler.

As described by especially referring to FIG. 1, the printer part 10 according to the present invention has the scanner unit 9 in the upper part. The stacker 13 is hardly operated by holding the stacker 13 itself due to the scanner unit 9. However, as described above, the operating lever 69 is operated so that the position of the stacker 13 can be changed to two ways. The position changing operation can be more easily performed than that of the structure in which an operation is carried out by holding the stacker 13 itself.

Additionally, the second regulating surface 59 and the fourth regulating surface 63 are formed in such a manner as described below. In the process for changing the position of the stacker 13 from the first position to the second position, the inclination angle of the stacker 13 when a state that the position of the stacker 13 is regulated by the abutment of the first engaging part 67 on the second regulating surface 59 is changed to a state that the position of the stacker 13 is regulated by the abutment of the second engaging part 68 on the fourth regulating surface 63 satisfies, assuming that the inclination angle immediately before the change (the inclination angle relative to a horizontal plane of the stacker 13 shown by a virtual line in FIG. 13) is $\alpha 1$ and the inclination angle immediately after the change (the inclination angle relative to the horizontal plane of the stacker 13 shown by a full line in FIG. 13) is +2, a relation expressed by $\alpha 1 > \alpha 2$, and the second engaging part 68 is opposed to the fourth regulating surface 63 immediately before the change.

Figure 13:
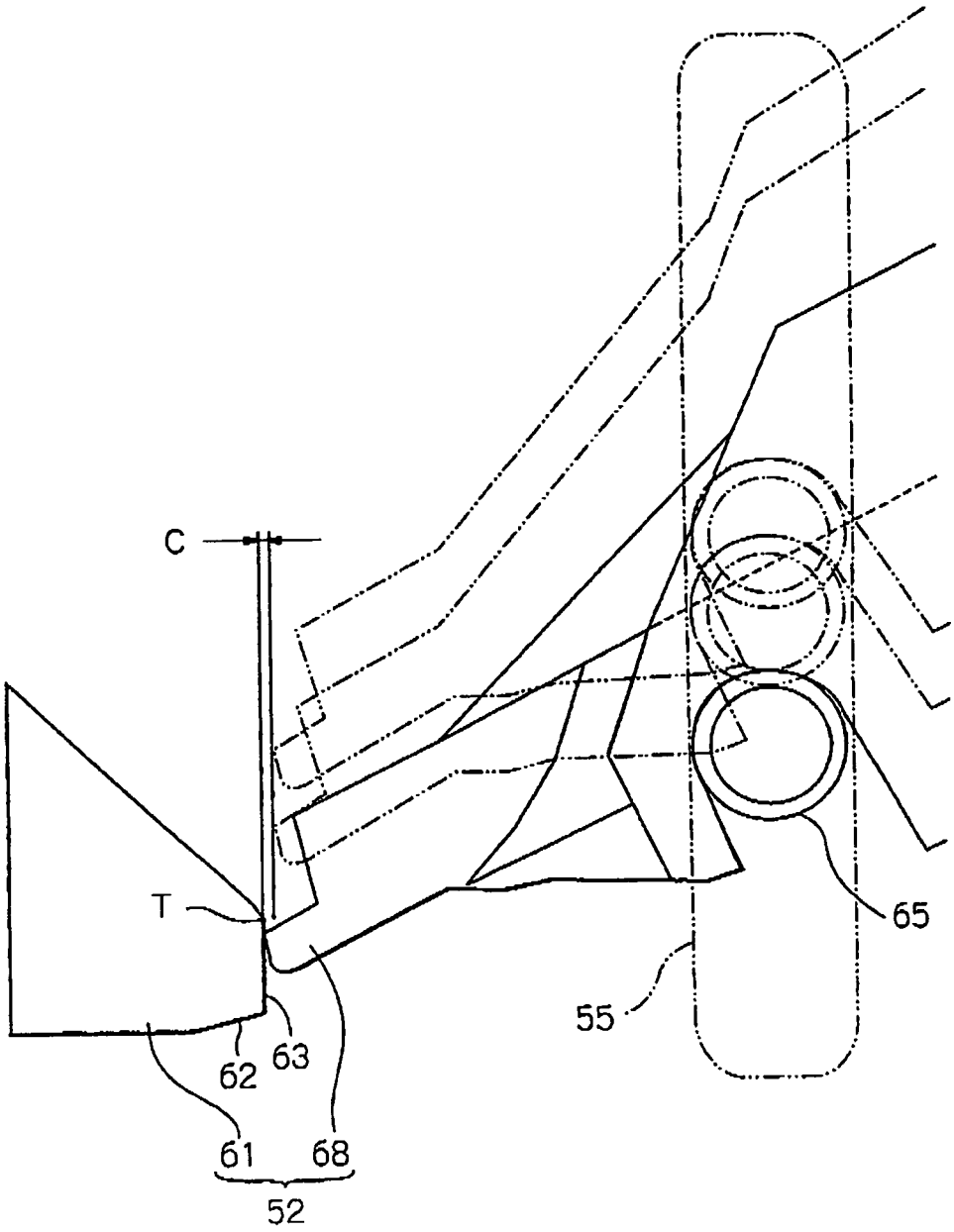
FIG. 13 is a side view of main parts of the position changing unit.

Accordingly, when the first engaging part 67 is separated from the second regulating surface 59 and the second engaging part 68 abuts on the fourth regulating surface 63, as shown in FIG. 13, a space C is formed between the second engaging part 68 and the fourth regulating surface 63. Further, the second engaging part 68 already passes an upper end (shown by reference character T) of a vertical surface forming the fourth regulating surface 63 and is located below the upper end. Thus, in the process for displacing the shaft 65 downward, the second engaging part 68 is not hooked on the upper end T of the vertical surface forming the fourth regulating surface 63 so that the first position can be assuredly changed to the second position.

<<3. Structure of Tray>>

Subsequently, referring to FIGS. 14 and 15, the structure of the tray 90 on which the optical disk as a recorded medium or an ejected medium will be described below.

Figure 15:
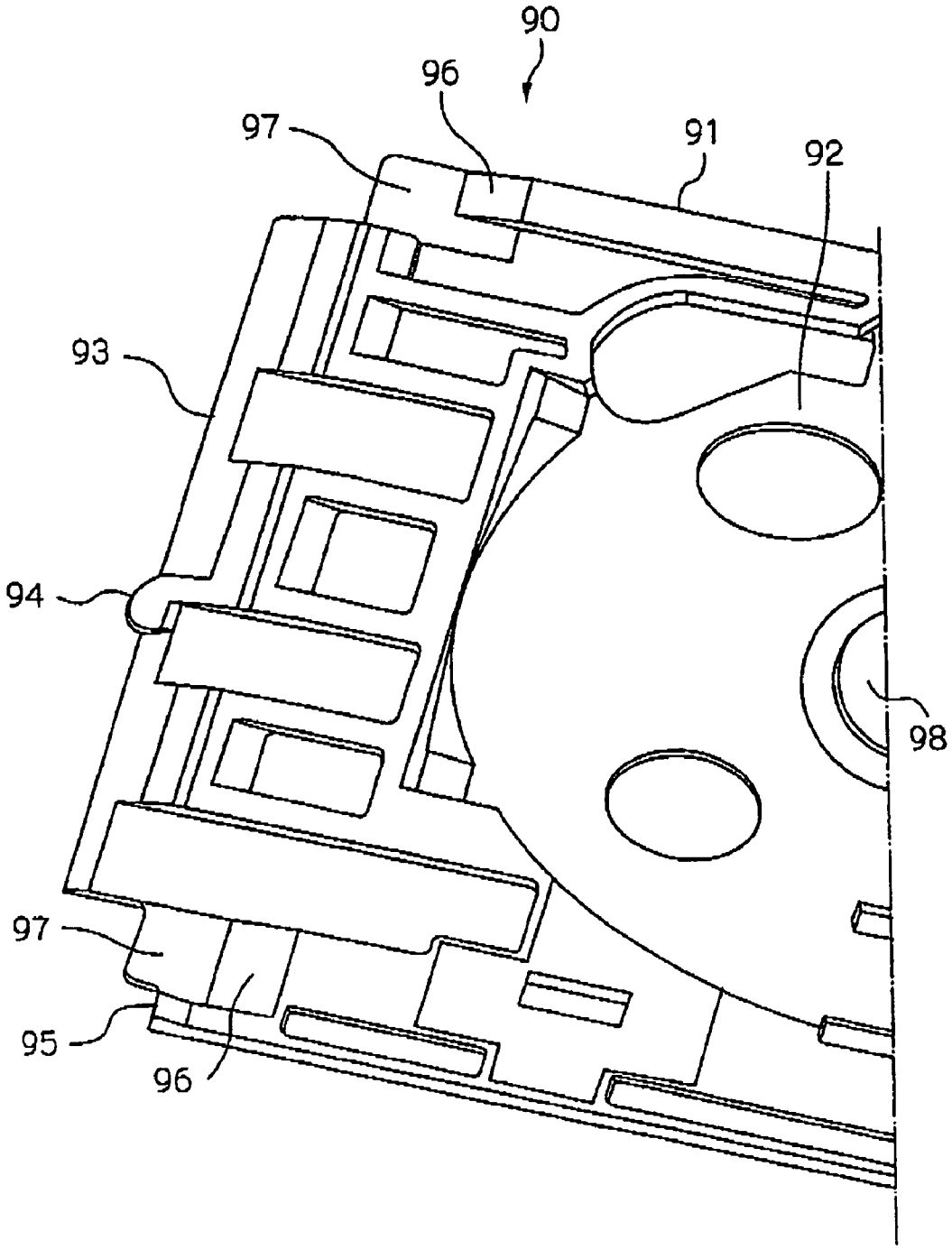
FIG. 15 is a perspective view of an end of the tray.

As shown in FIG. 15, the tray 90 has a rectangular form in a plan view and forms a plate shape that can be nipped by the transport driving roller 30 and the transport follower roller 31 and sub-scanning fed in accordance with the rotation of the transport driving roller 30.

The tray 90 is formed integrally with a resin material so as to have a tray main body 91 and a set part 92. The set part 92 is formed by a recessed part having a circular shape in a plan view as shown in the drawing. In the center of the set part 92, a protruding part 98 is formed. When the optical disk is set on the set part 92, the central hole of the optical disk is fitted to the protruding part 98, so that the position of the optical disk in the set part 92 is determined.

Figure 14:
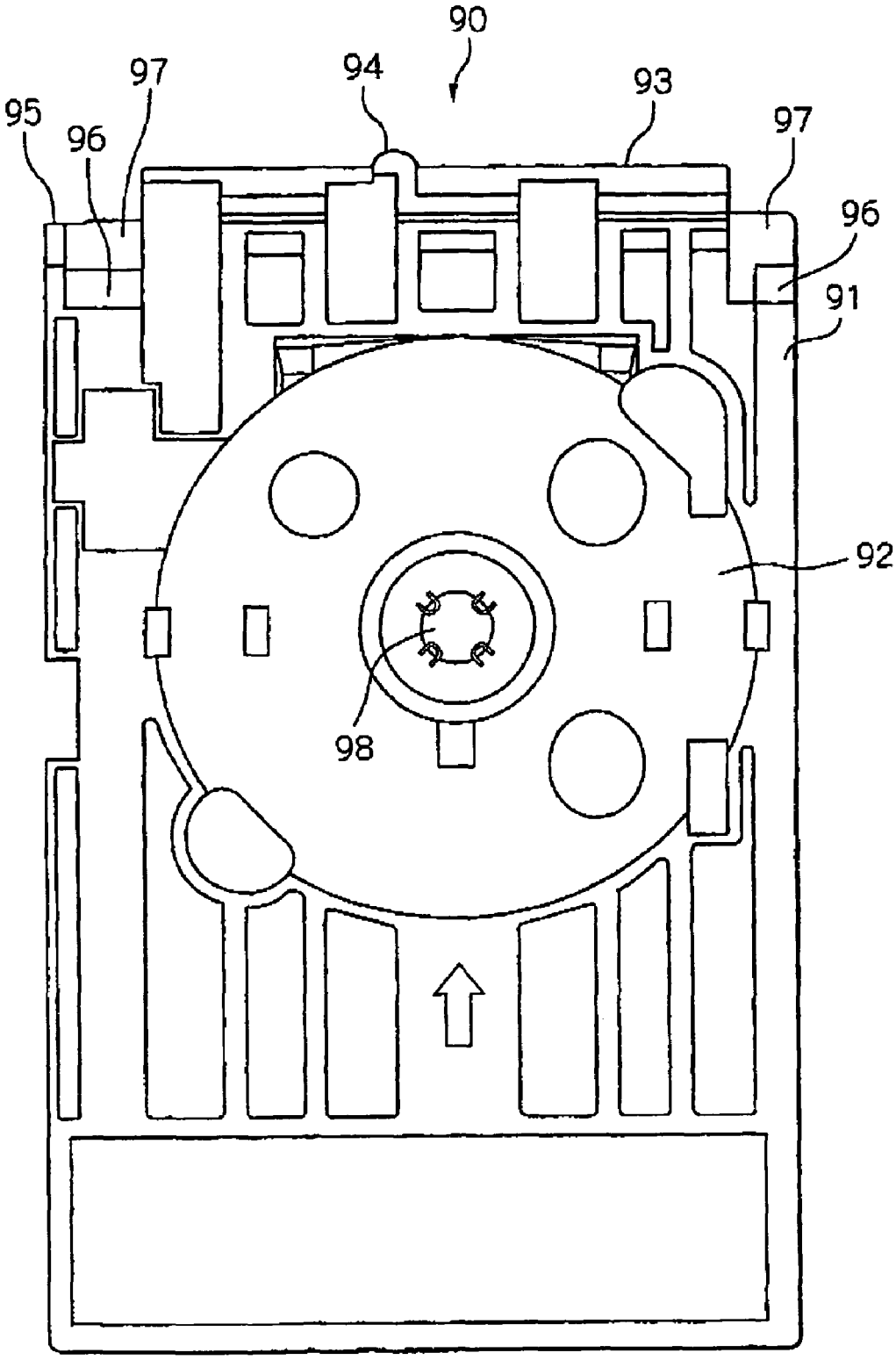
FIG. 14 is a plan view of a tray.

The vertical direction of FIG. 14 is a transport direction of the tray 90. When the tray 90 is inserted (fed) into the linear transport path through the stacker 13 located in the first position, an upper part shown in FIG. 14 is inserted as an end. That is, reference numeral 93 shows the end of the tray 90. This end 93 is extended to the inserting direction (upward in FIG. 14) of the tray 90 relative to a horizontal surface 97 and an inclined surface 96. This will be described below in detail.

Then, in the end 93 of the tray 90, a tongue piece 94 is formed integrally with the tray 90 so as to protrude to the inserting direction. The tongue piece 94 is tapered toward the end in a plan view and a side sectional view (not shown) and its bottom surface is formed as a flat surface together with the bottom surface of the tray main body 91. The end 93 of the tray 90 is formed to be tapered toward an end in a side sectional view (not shown) like the tongue piece 94.

The end 93 is tapered because of the following reasons. Namely, when the tray 90 is inserted into the linear transport path, the tray 90 is inserted with the end 93 of the tray 90 placed at a head position toward an interior side of the device through the stacker 13 located in the first position. At this time, the ejecting follower roller 42 is separated from the ejecting driving roller 41 by a below-described roller position changing unit 5 and the pressing roller 78 (FIG. 1) moves forward to the transport path, so that the tray 90 is nipped in between the ejecting driving roller 41 and the pressing roller 78 (viewing the transport path from a side). Then, under this state, the ejecting driving roller 41 is rotated and driven so that the tray 90 is fed to the transport roller 29.

To sub-scanning feed the tray 90 by the transport driving roller 30 and the transport follower roller 31, the end 93 of the tray 90 needs to be inserted between the transport driving roller 30 and the transport follower roller 31. Since the end 93 of the tray 90 is provided with the tongue piece 94, when the tray 90 is transported to the transport roller 29 in accordance with the rotation of the ejecting driving roller 41, the tongue piece 94 enters between the transport driving roller 30 and the transport follower roller 31. As a result, then, the end 93 of the tray 90 enters between the transport driving roller 30 and the transport follower roller 31, so that the tray 90 is nipped between by both the rollers.

That is, since the area (according to a plan view) of the end of the tray 90 is extremely reduced owing to the tongue piece 94, the end 93 of the tray 90 can be easily inserted between the transport driving roller 30 and the transport follower roller 31 with a small force. Thus, the tray 90 can be inserted between the transport driving roller 30 and the transport follower roller 31 without using a unit for separating (release) the transport follower roller 31 from the transport driving roller 30.

In the end side of the tray 90, the horizontal surfaces 97 and the inclined surfaces 96 are formed in parts near both side ends. The functions of the horizontal surface 97 and the inclined surface 96 will be described below in detail.

<<4. Structure of Urging Device and Roller Position Changing Unit>>

Subsequently, referring to FIGS. 16 to 25, the structure of an urging device (a torsion spring 49) for urging the sheet ejection frame Assy 45 toward the contact position and the structure of the roller position changing unit 5 for displacing the sheet ejection frame Assy 45 to the separate position from the contact position will be described below in detail.

<<4-1. Structure of Urging Device>>

Figure 16:
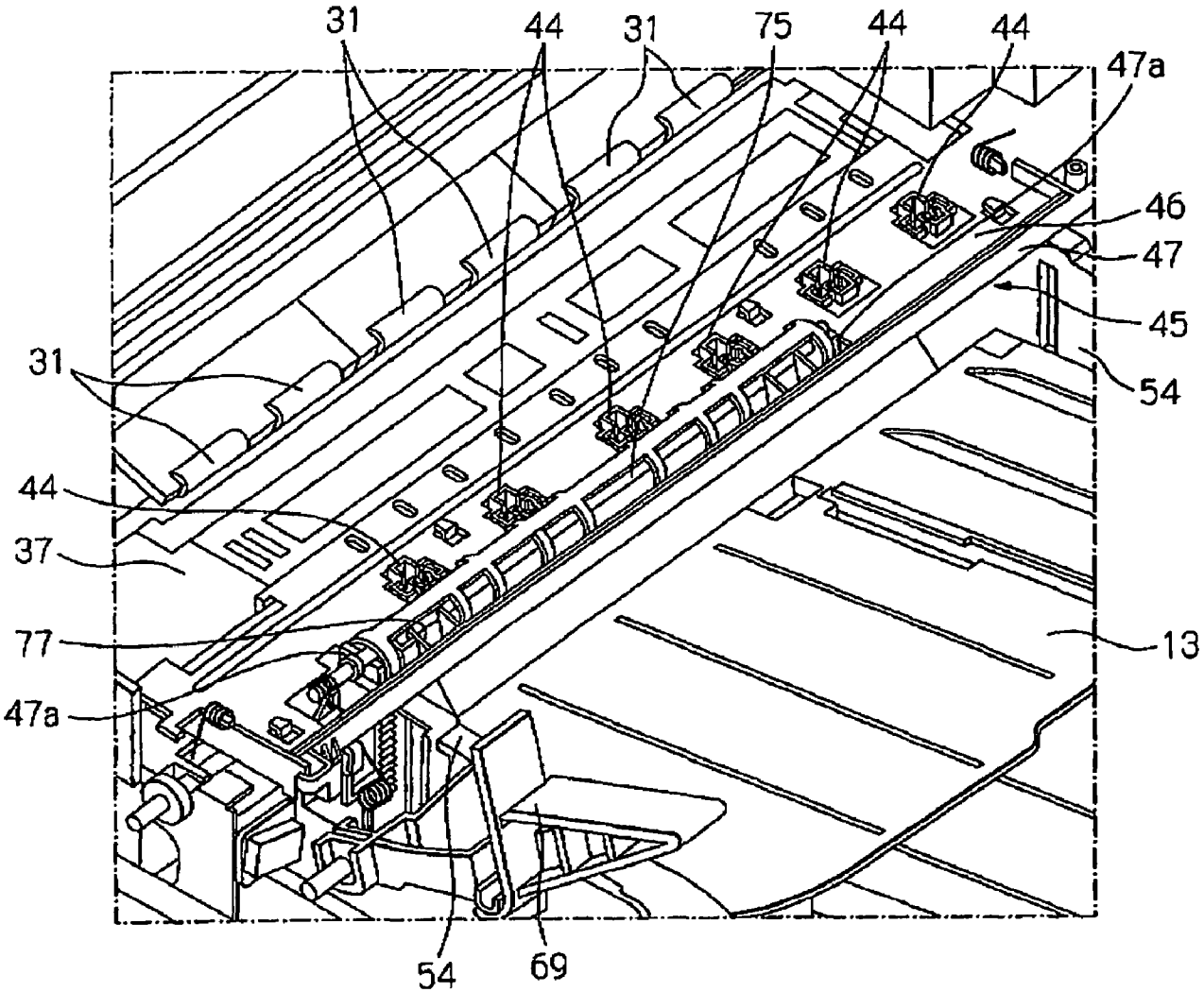
FIG. 16 is a perspective view showing the attaching state of a sheet ejection frame Assy.
Figure 17:
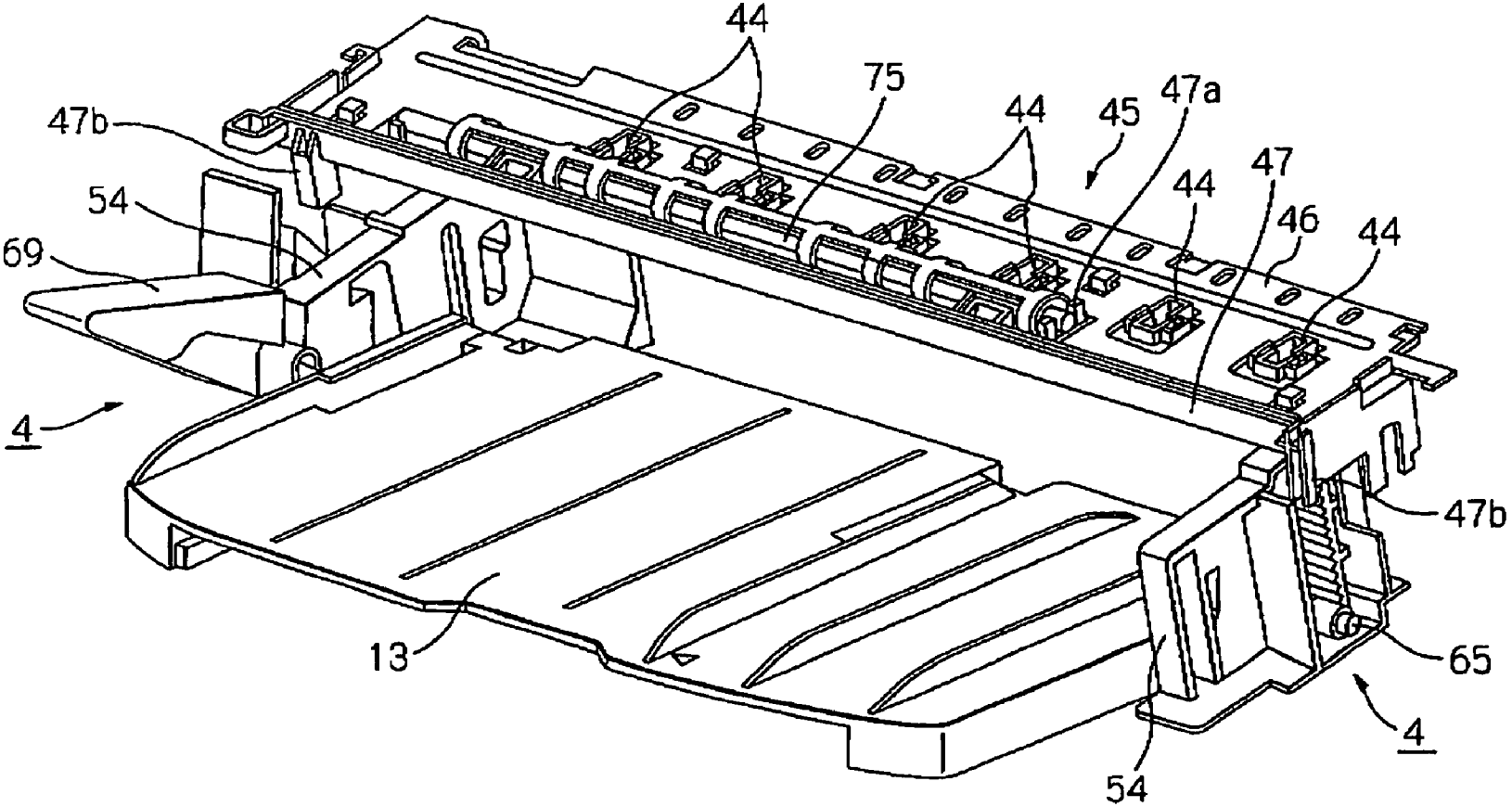
FIG. 17 is a perspective view of the sheet ejection frame Assy, the stacker, and the position changing unit.

As shown in FIGS. 16 and 17, the sheet ejection frame Assy 45 includes a sheet ejection frame 46 made of a metal plate material and a roller support member 47 made of a resin material and has a form extending in a main scanning direction (a direction of width of a sheet).

In the roller support member 47, holder parts 44 for supporting the ejecting follower roller 42 are integrally formed so as to exist at intervals in the main scanning direction. Further, bearing parts **47*a* and 47*a* for supporting the below-described release member 75** are integrally formed.

The sheet ejection frame Assy 45 is provided so as to be displaced between a first position (refer it to as a "contact position", hereinafter: see FIG. 2) where the ejecting follower roller 42 comes into contact with the ejecting driving roller 41 by a guide unit not shown in the drawing and a second position (refer it to as a "separate position", hereinafter: see FIG. 26) where the ejecting follower roller 42 is separated from the ejecting driving roller 41. Further, the sheet ejection frame Assy 45 is urged to move toward the contact position by the torsion spring (the urging device) 49 shown in FIGS. 19A to 20B.

Figure 26:
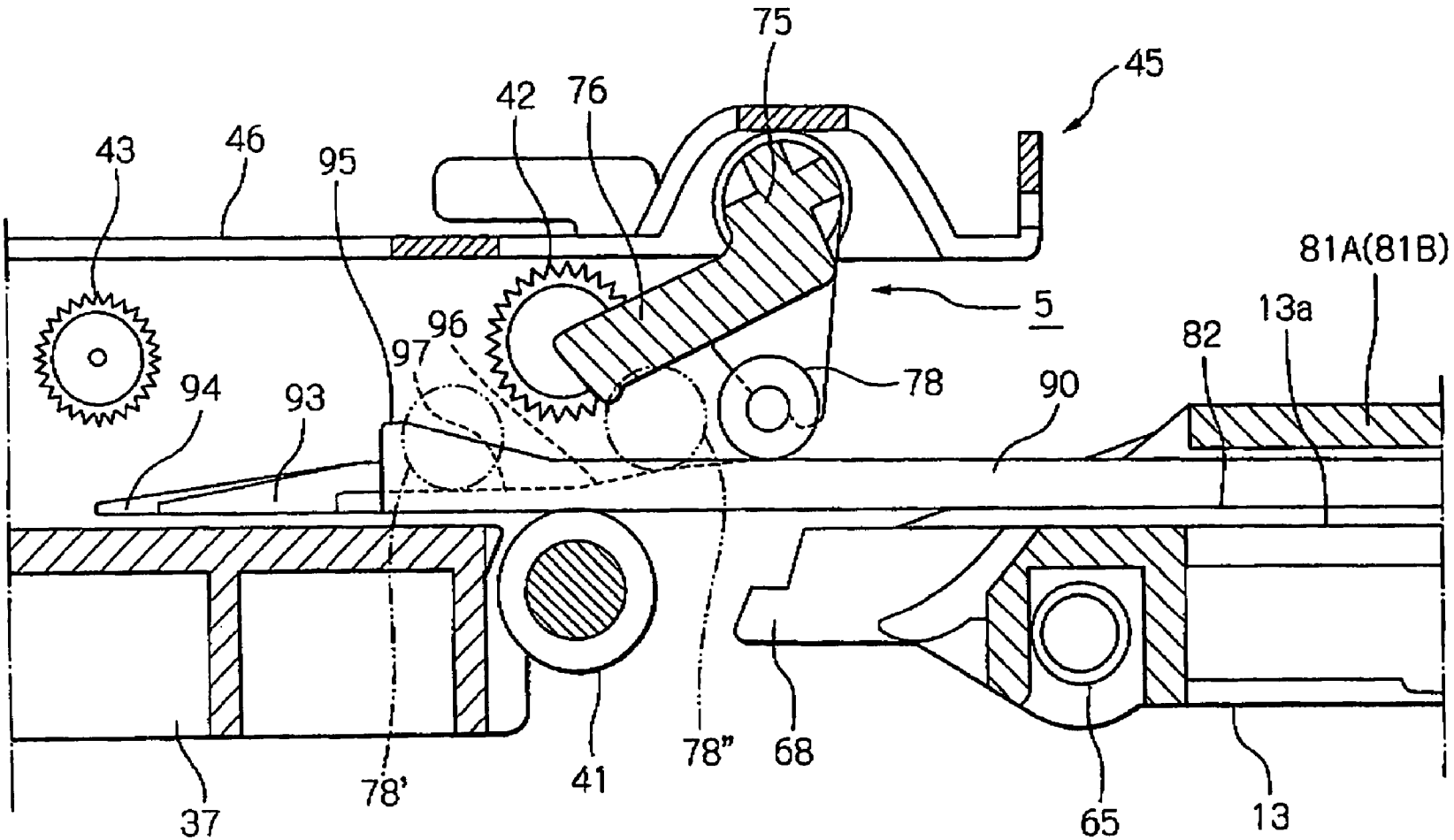
FIG. 26 is a side sectional view of the transport path in the periphery of the sheet ejection frame Assy.

In the separate position, the sheet ejection frame Assy 45 is held in a substantially horizontal position as shown in FIG. 26. This state arises because of the following reason. The upper part of the upstream side of the sheet ejection frame Assy 45 corresponds to a main scanning area of the carriage 35. Accordingly, for instance, when the position of the sheet ejection frame Assy 45 is located in an inclined position where the upstream side of the sheet ejection frame Assy 45 is directed slantingly upward, the end part of the upstream side of the sheet ejection frame Assy 45 undesirably interferes with the carriage 35. Thus, as described above, in the separate position, the sheet ejection frame Assy 45 is placed in the horizontal position so that the sheet ejection frame Assy 45 is not greatly separated from the carriage 35 and the interference of both the members is prevented so as to prevent the enlargement of the device.

Now, the torsion spring (the urging device) 49 for urging the sheet ejection frame Assy 45 will be described in detail below. As shown in FIGS. 19A to 20B, in both end parts in the longitudinal direction of the sheet ejection frame 46 (one end part is shown in FIGS. 19A to 20B), tongue pieces 46*a* are formed that extend in parallel with (a direction from the front to the back of a sheet surface in FIGS. 20A and 20B) a sheet transport path on a surface (an upper surface) of the contact position side. A torsion part 49*a* of the torsion spring 49 is fitted to the tongue piece 46*a*.

Figure 19A:
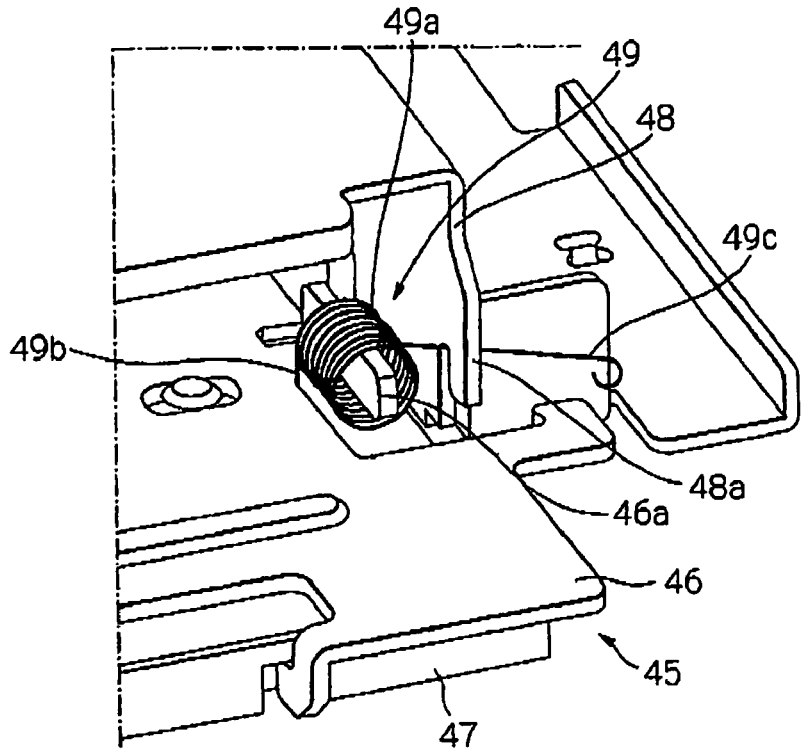
FIGS. 19A and 19B are perspective views of a torsion spring (an urging device).
Figure 19B:
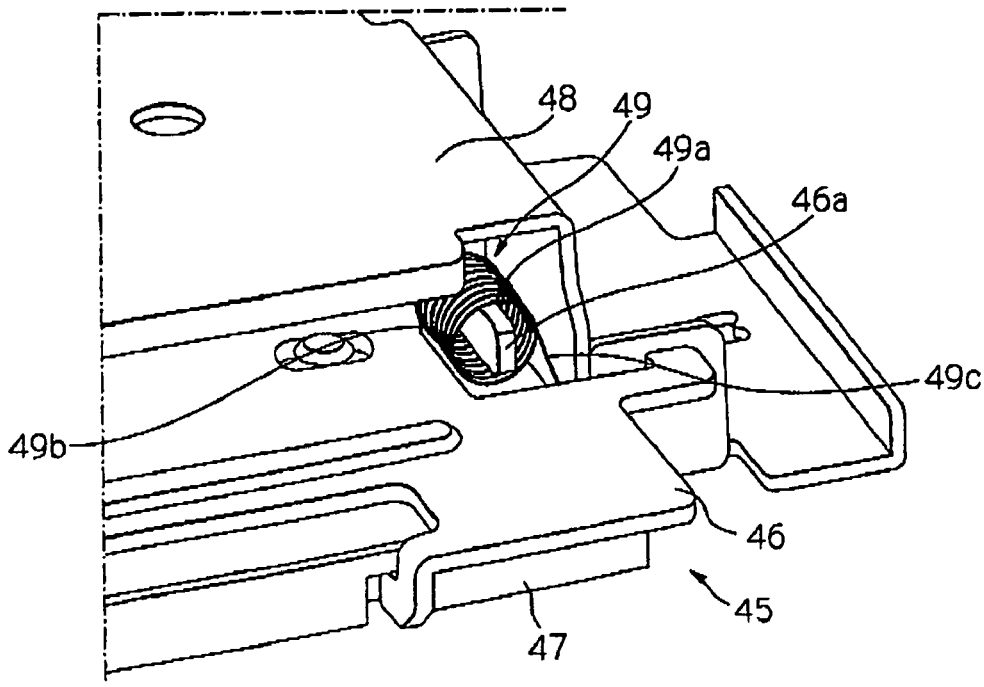
Figure 20A:
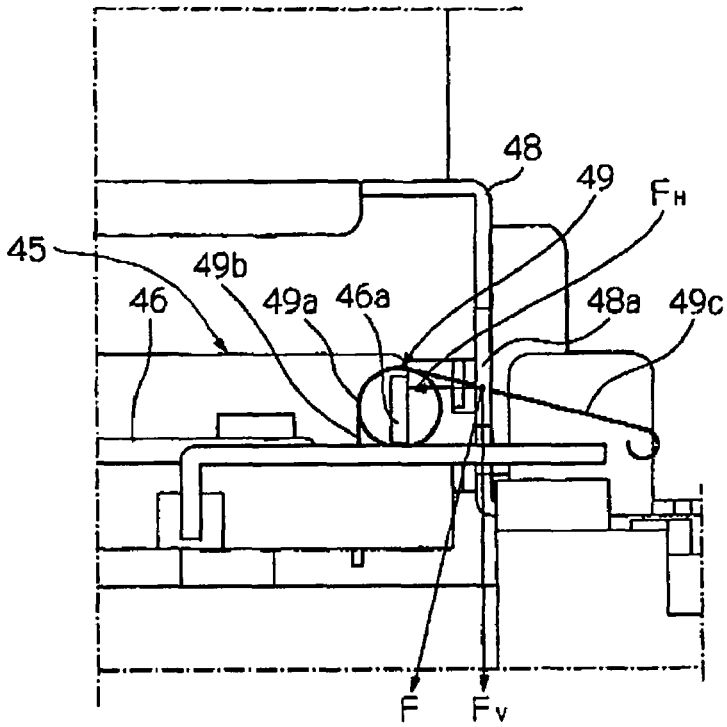
FIGS. 20A and 20B are front views of the torsion spring (the urging device).

Then, one end 49*b* of the torsion spring 49 is suspended substantially vertically to the sheet ejection frame 46 from the torsion part 49*a* and is engaged with the sheet ejection frame 46. The other end 49*c* extends in the direction intersecting the displacing direction (upward and downward in FIGS. 20A and 20B) of the sheet ejection frame Assy 45 with respect to the torsion part 49*a* when the sheet ejection frame Assy 45 is located in the contact position as shown in FIGS. 19A and 20A and is engaged with an engaging part 48*a* formed in a frame 48 located in the same direction. Thus, the torsion spring 49 has a prescribed opening angle when the sheet ejection frame Assy 45 is located in the contact position.

Since the torsion spring 49 exerts an urging force to open the one end 49*b* and the other end 49*c*, a component of force Fv in the vertical direction (the displacing direction of the sheet ejection frame Assy 45) of an urging force F for urging the engaging part 48*a* by the other end 49*c* serves as an urging force for urging the sheet ejection frame Assy 45 toward the contact position.

Figure 20B:
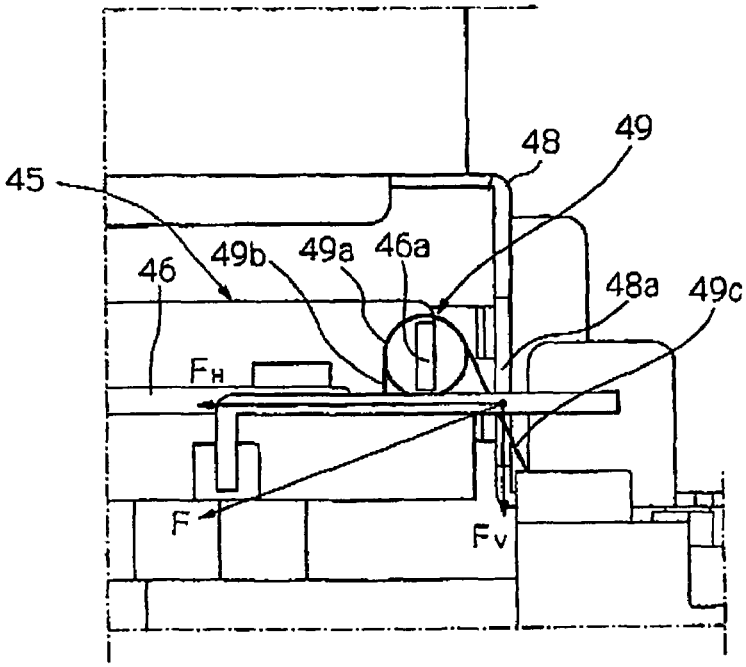

Here, in the contact position of the sheet ejection frame Assy 45 shown in FIG. 20A, since the other end 49*c* of the torsion spring 49 extends at an angle (a steep angle) near the direction intersecting at right angles to the displacing direction (upward and downward) of the sheet ejection frame Assy 45, the component of force Fv is relatively large. However, as shown in FIG. 20B, when the sheet ejection frame Assy 45 is located in the separate position, the other end 49*c* of the torsion spring 49 extends at an angle (a gentle angle) near the direction along the displacing direction (the vertical direction or upward and downward) of the sheet ejection frame Assy 45, the component of force Fv is small.

That is, the torsion spring 49 for urging the sheet ejection frame Assy 45 is provided so that its position is changed in accordance with the displacing operation of the sheet ejection frame Assy 45. Further, the component of force Fv for urging the sheet ejection frame Assy 45 toward the contact position is more decreased in accordance with the change of the position of the torsion spring as the sheet ejection frame Assy 45 is moved to the separate position from the contact position.

This phenomenon arises because of the following reasons. Namely, when a printing operation is carried out on the sheet P such as an ordinary sheet or an exclusive sheet, if the ejecting follower roller 42 is separated from the ejecting driving roller 41, the sheet P cannot be ejected. Otherwise, there is a fear that the sheet P floats so that the recording head 36 rubs the sheet P, and accordingly, a printing surface is stained. Therefore, when the sheet P such as the ordinary sheet or the exclusive sheet is printed, the sheet ejection frame Assy 45 is desirably assuredly held in the contact position.

In order to assuredly hold the sheet ejection frame Assy 45 in the contact position, for instance, a strong compression spring or the like is effectively provided between the sheet ejection frame Assy 445 and the frame 48 located above the sheet ejection frame Assy 45. However, when the urging force is simply increased in such a way, if a printing operation is carried out on the label surface of the optical disk, an operating force for displacing the sheet ejection frame Assy 45 to the separate position from the contact position is extremely increased as the frame Assy 45 moves toward the separate position from the contact position. As a result, a work volume is increased so as to lower operability.

However, as described above, since the torsion spring 49 for urging the sheet ejection frame Assy 45 to the contact position changes its position in accordance with the displacing operation of the sheet ejection frame Assy 45 and the component of force Fv for urging the sheet ejection frame Assy 45 toward the contact position is more decreased as the frame Assy 45 moves from the contact position to the separate position in accordance with the change of the position of the torsion spring, the urging force for urging the sheet ejection frame Assy 45 becomes maximum in the contact position requiring the largest urging force. Thus, the sheet ejection frame Assy 45 can be assuredly held.

Since the urging force is more decreased as the sheet ejection frame Assy 45 moves from the contact position to the separate position, a work volume is not increased when the sheet ejection frame Assy 45 is displaced to the separate position and the operability can be prevented from being lowered. Especially, in this embodiment, since, as the tray 90 is inserted by the below-described roller position changing unit 5, the sheet ejection frame Assy 45 is displaced to the separate position, a resistance when the tray 90 is inserted can be decreased and the inserting characteristics of the tray 90 can be improved.

Further, the torsion spring 49 is provided in the sheet ejection frame Assy 45, so that a space for installing the torsion spring 49 can be suppressed to a minimum. Thus, the device can be miniaturized.

When the sheet ejection frame Assy 45 is located in the separate position, a component of force $F_H$ of the direction intersecting at right angles with the displacing direction of the sheet ejection frame Assy 45 becomes large. However, the torsion springs 49 are arranged at both end parts in the longitudinal direction of the sheet ejection frame Assy 45, and accordingly, even when the components of force $F_H$ are increased, they are cancelled each other so that an adverse influence is not given to the sheet ejection frame Assy 45.

<<4-2. Structure of Roller Changing Unit>>

Subsequently, the roller position changing unit 5 for displacing the sheet ejection frame Assy 45 from the contact position to the separate position and displacing the pressing roller 78 from a non-pressing position to a pressing position will be described in detail.

The roller position changing unit 5 is provided with a release member 75 shown in FIGS. 21 to 26. The release member 75 is formed with a shaft member extending in the main scanning direction. Shaft end parts 75*a* and 75*a* thereof are fitted in a snap-fit manner to the bearing parts 47*a* and 47*a* formed in the roller support member 47 as shown in FIG. 16, so that the release member is supported by the roller support member 47 so as to freely rotate.

Figure 21:
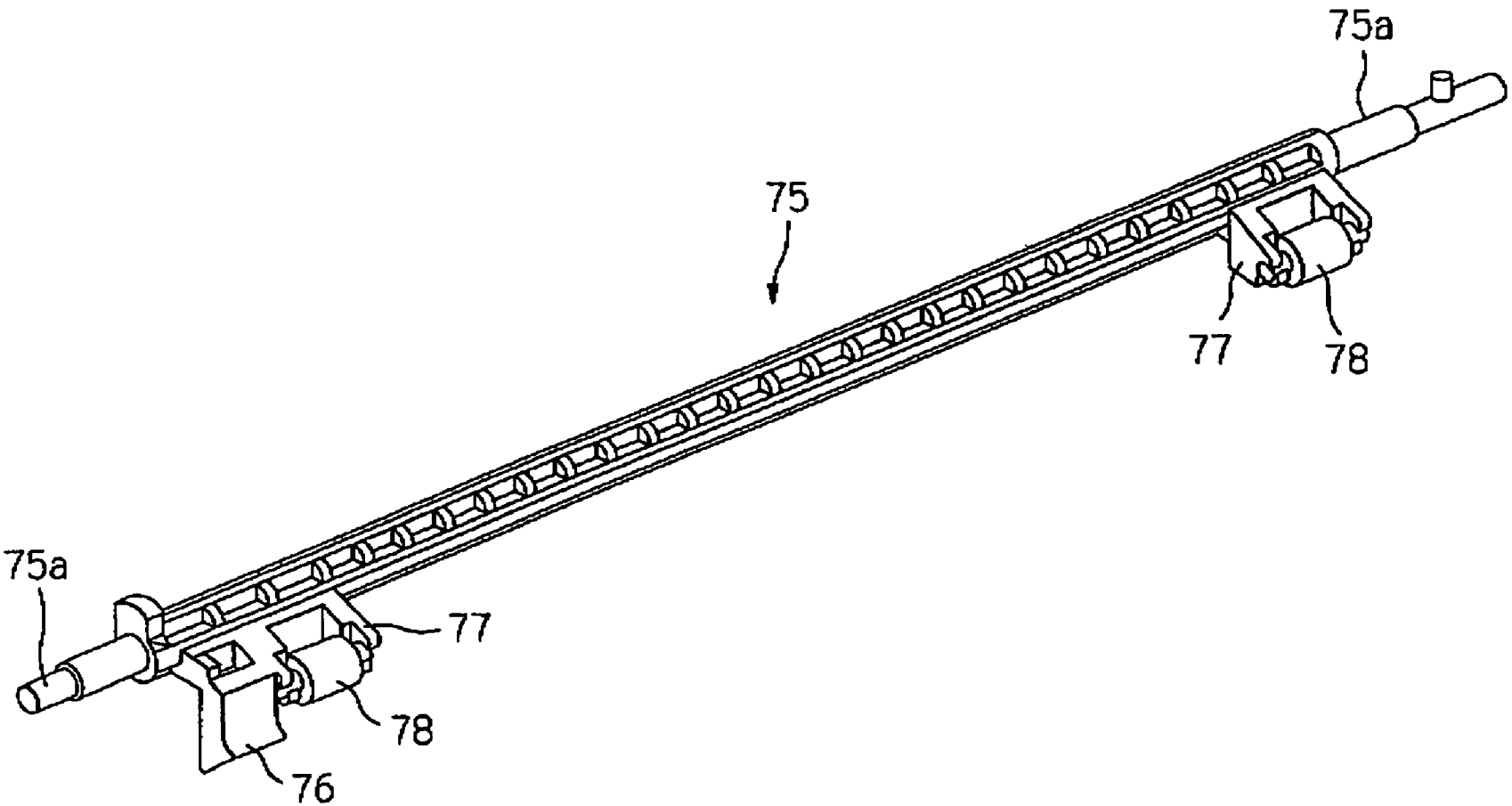
FIG. 21 is a perspective view of an external appearance of a release member.

As shown in FIG. 21, in the vicinity of one shaft end part 75*a* of the release member 75, a lever part 76 is formed. Further, in the vicinity of the lever part 76 and the other shaft end part 75*a*, the pressing rollers 78 (for instance, made of rubber rollers) are respectively supported by bearing parts 77 so as to freely rotate.

Figure 22:
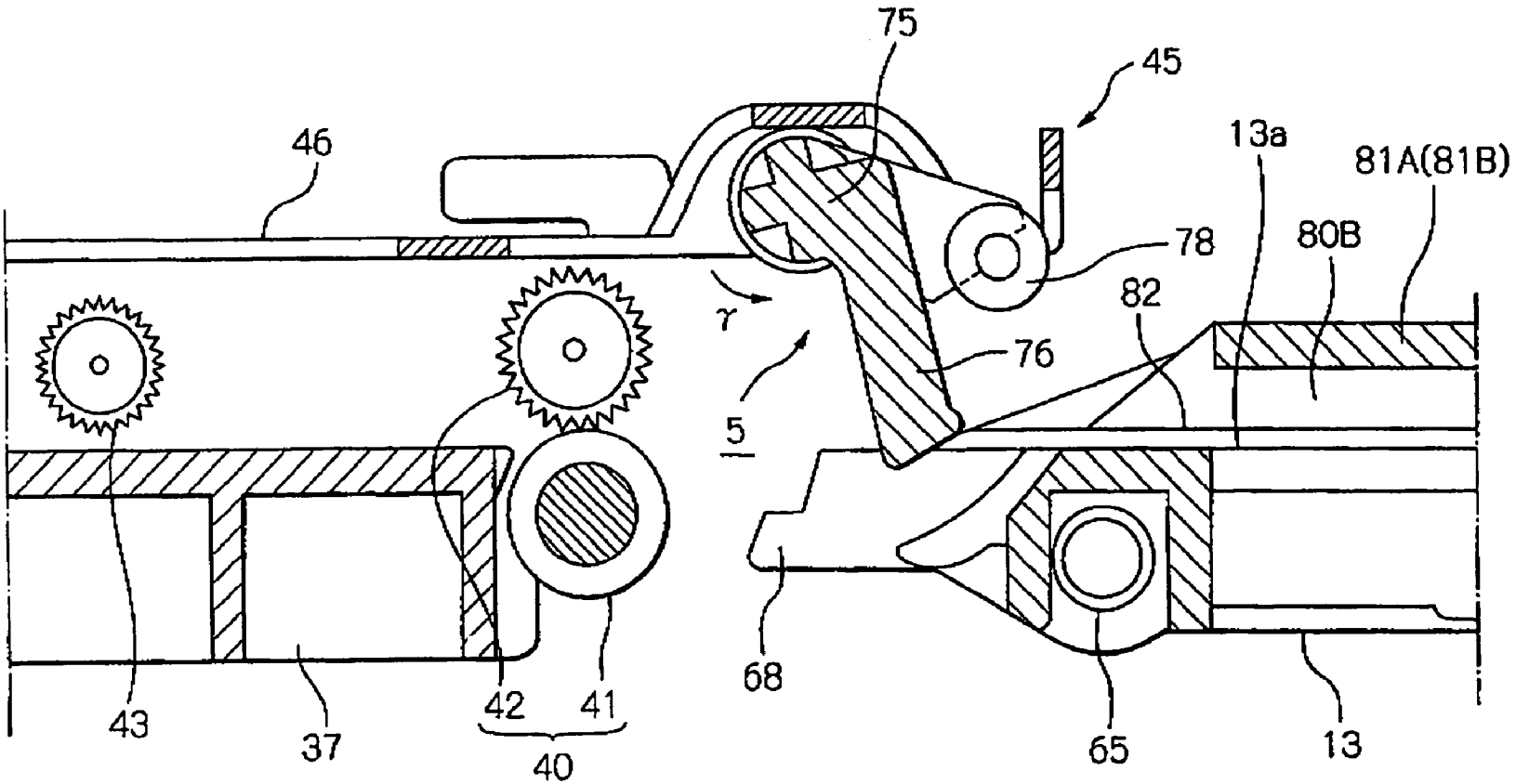
FIG. 22 is a side sectional view of a transport path in the periphery of the sheet ejection frame Assy.
Figure 23:
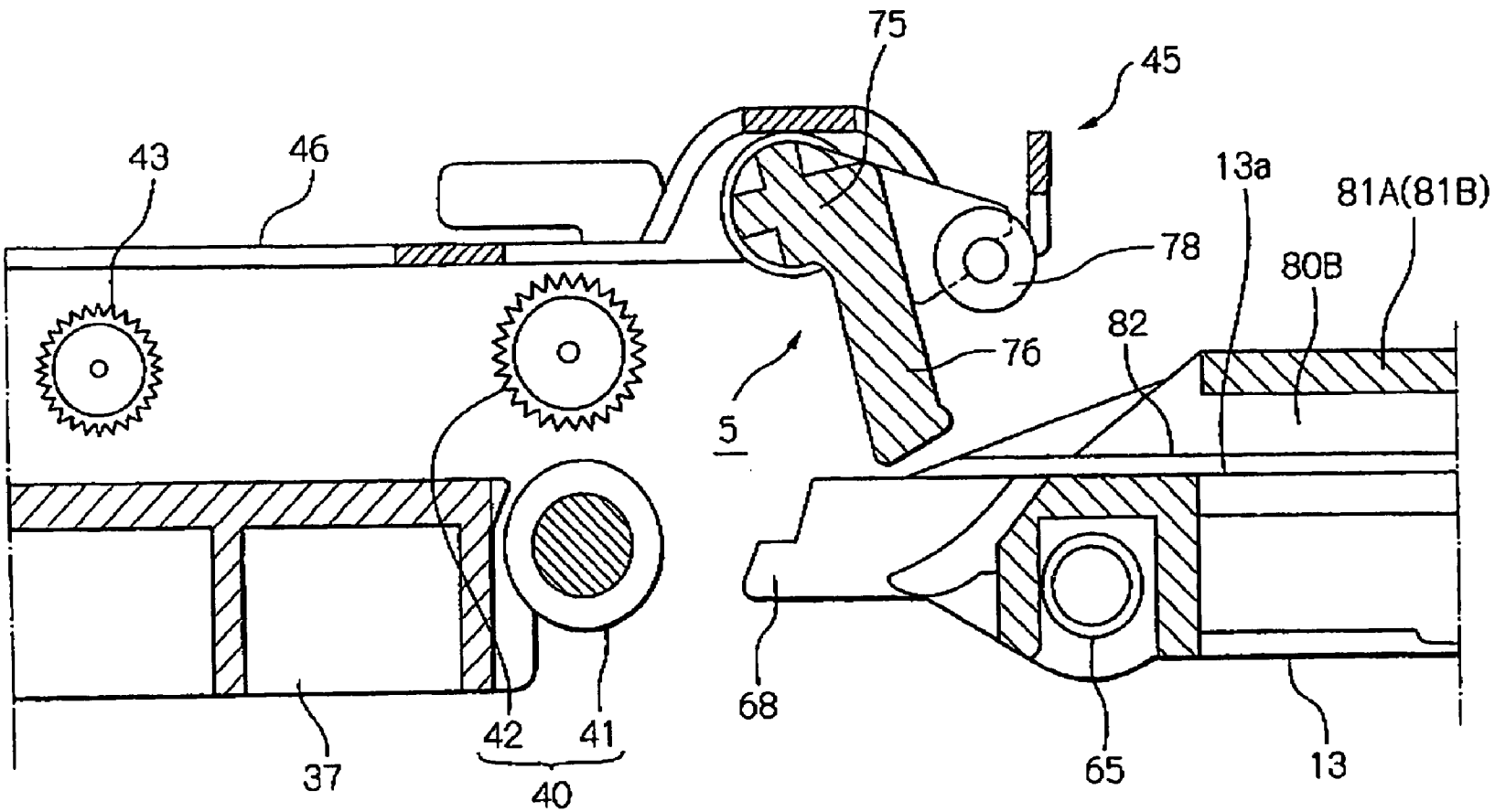
FIG. 23 is a side sectional view of the transport path in the periphery of the sheet ejection frame Assy.
Figure 24:
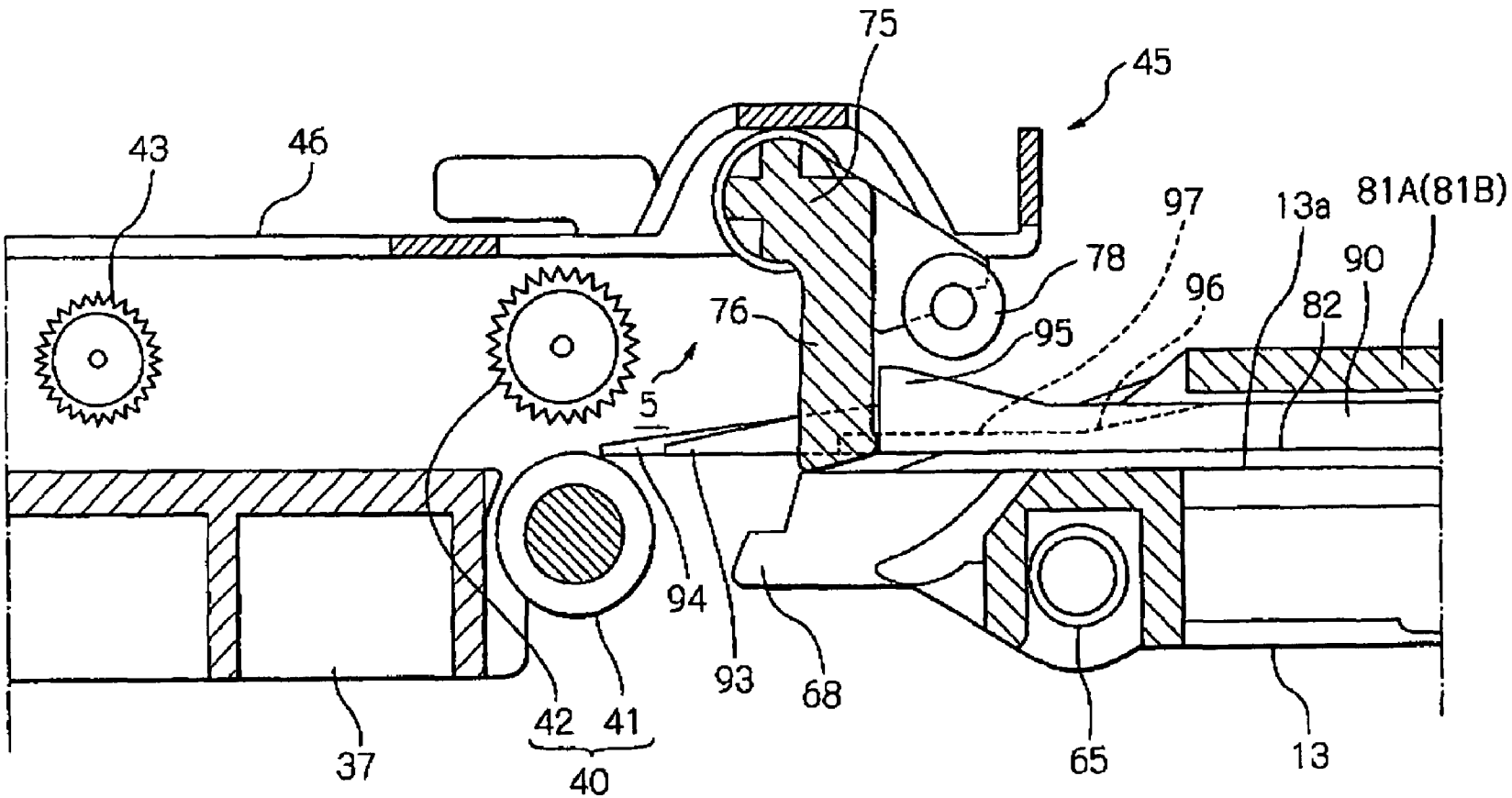
FIG. 24 is a side sectional view of the transport path in the periphery of the sheet ejection frame Assy
Figure 25:
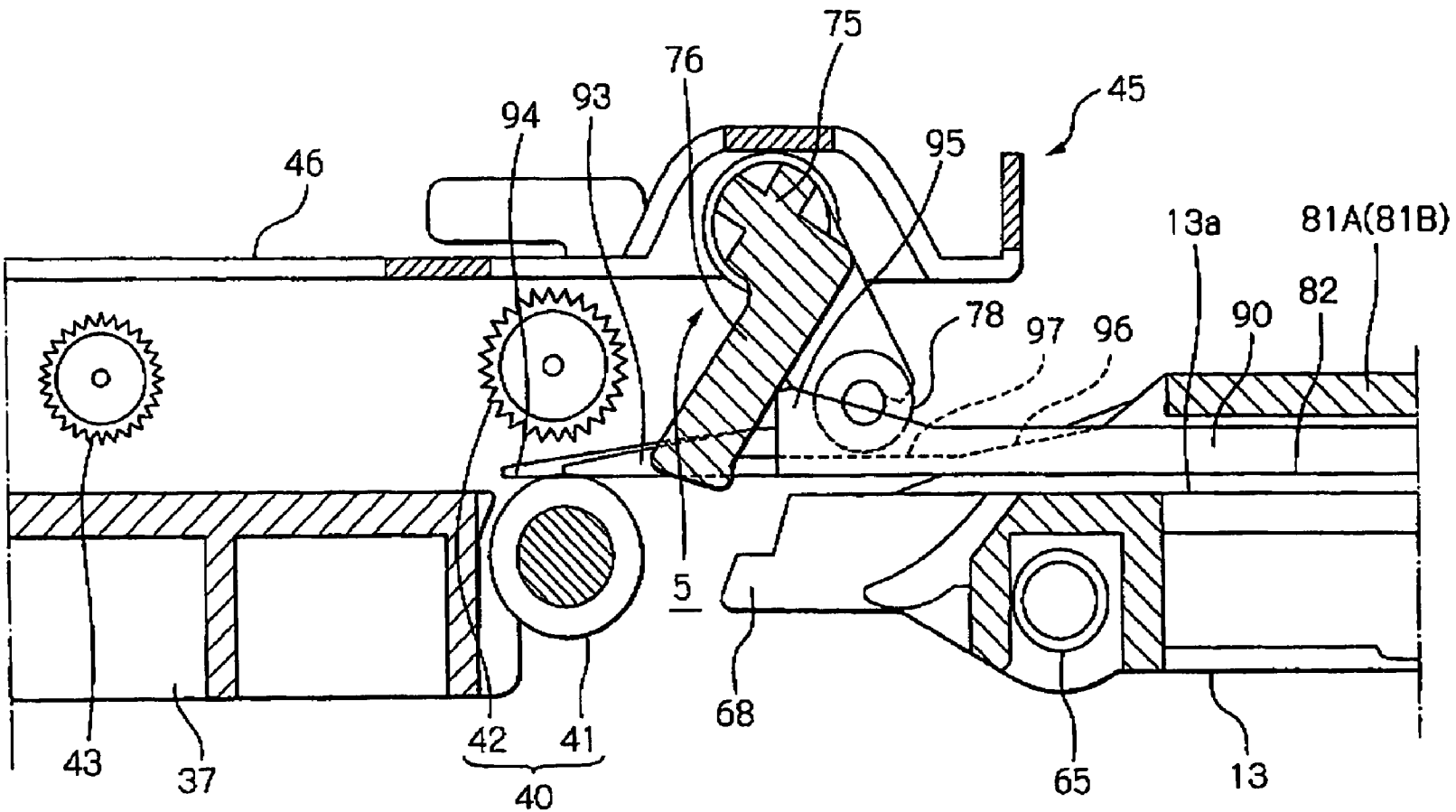
FIG. 25 is a side sectional view of the transport path in the periphery of the sheet ejection frame Assy.

FIG. 22 shows a state that the ejecting follower roller 42 comes into contact with the ejecting driving roller 41 (the contact position of the sheet ejection frame Assy 45). FIG. 26 shows a state that the ejecting follower roller 42 is separated from the ejecting driving roller 41 (the separate position of the sheet ejection frame Assy 45). FIGS. 23 to 25 show a state that the sheet ejection frame Assy 45 is located between the contact position and the separate position. FIGS. 22 to 24 show a state the pressing roller 78 is located in the non-pressing position. FIGS. 25 and 26 show a state that the pressing roller 78 is located in the pressing position.

In FIG. 22 showing a state that the sheet ejection frame Assy 45 is located in the contact position and the stacker 13 is located in the second position, as shown in the drawing, the lever part 76 protrudes to the transport path of the tray 90 and the pressing roller 78 is retracted (the non-pressing position) from the transport path of the tray 90. Here, the release member 75 is urged to rotate (a direction shown by an arrow mark γ in FIG. 22) so that the lever part 76 protrudes to the transport path of the tray 90 by the urging force of an urging unit not shown in the drawing (for instance, a torsion spring).

Here, as shown in FIG. 17, the sheet ejection frame Assy 45 is provided in the upper part of the stacker 13. In both end parts in the longitudinal direction of the roller support member 47, leg parts 47*b* are formed so as to be suspended downward.

Figure 18A:
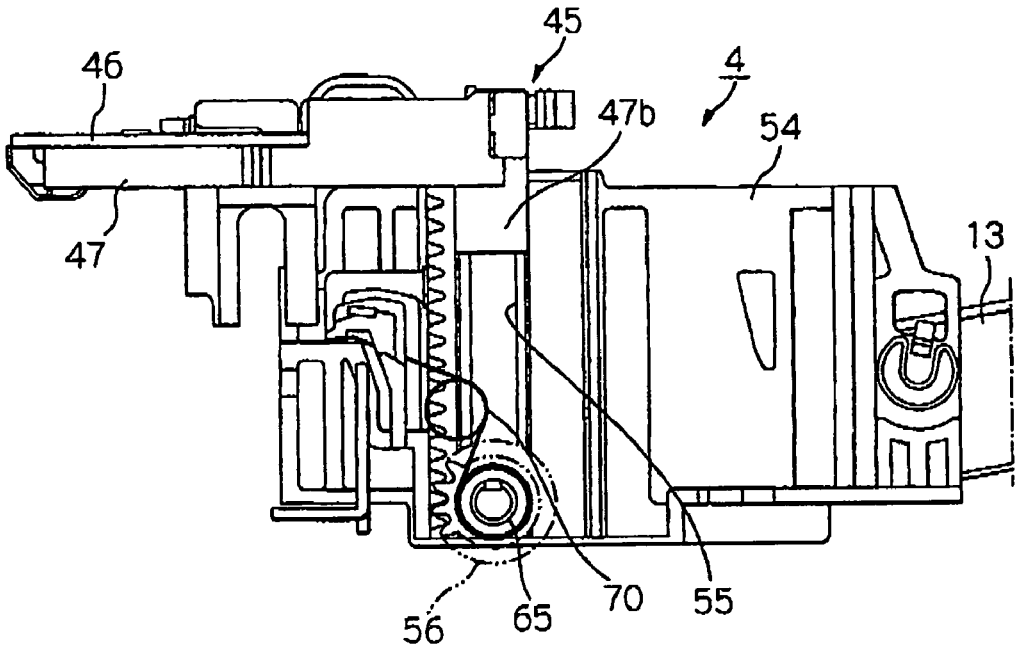
FIGS. 18A and 18B are side views of the sheet ejection frame Assy, the stacker, and the position changing unit.
Figure 18B:
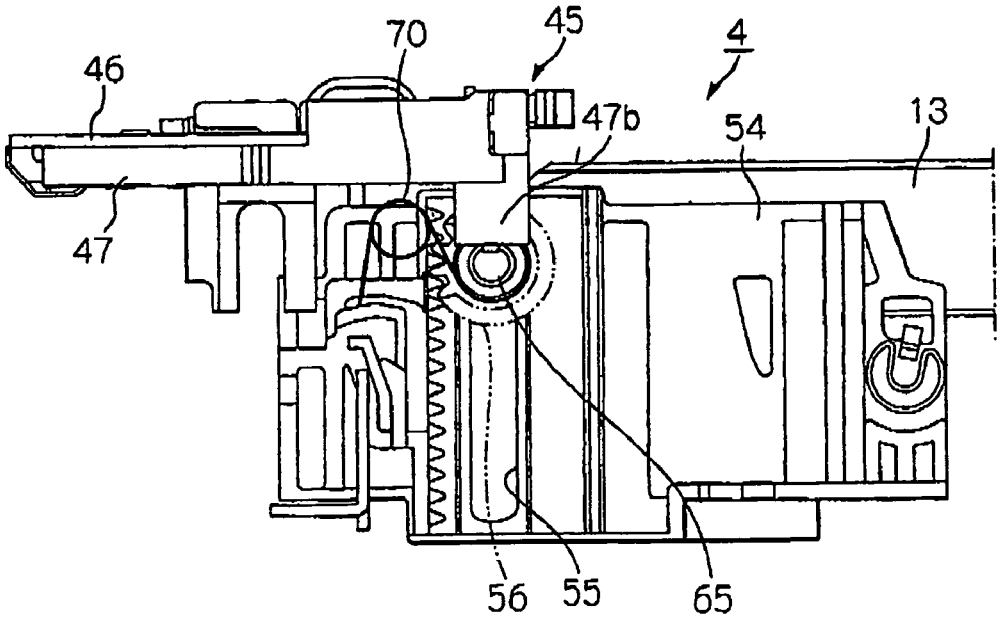

As shown in FIGS. 18A and 18B, the leg parts 47*b* are located in the upper parts of the shaft 65 forming the position changing unit 4 and engaged with the shaft 65 when the position of the stacker 13 is changed from the second position (FIG. 18A) to the first position (FIG. 18B) so that the leg parts 47*b* are pushed up by a prescribed amount by the shaft 65 (FIG. 18B, FIG. 23).

That is, when the position of the stacker 13 is switched from the second position to the first position, the sheet ejection frame Assy 45 is previously pushed up by a prescribed amount by the shaft 65. Thus, when the tray 90 is manually inserted, the sheet ejection frame Assy 45 is already displaced upward by a prescribed amount to the separate position from the contact position. Accordingly, the work volume when the sheet ejection frame Assy 45 is displaced to the separate position afterward is decreased and the sheet ejection frame Assy 45 can be easily displace to the separate position with a minimum labor Particularly, in this embodiment, when the sheet ejection frame Assy 45 is located in the contact position, the component of force for urging the sheet ejection frame Assy 45 to the contact position by the torsion spring 49 (FIGS. 19A and 19B) is adapted to become maximum. That is, the work volume of the sheet ejection frame Assy 45 for a unit amount of displacement becomes the largest in a displacement start part from the contact position and the displacement start part from the contact position that most requires the work volume as described above is secured by the position changing operation of the stacker 13. Thus, when the sheet ejection frame Assy 45 is displaced to the separate position afterward, the work volume can be more reduced, so that the sheet ejection frame Assy can be easily displaced to the separate position with a little force.

Now, under a state that the sheet ejection frame Assy 45 is elevated by a prescribed amount to the separate position from the contact position (FIG. 23), when the tray 90 is inserted from the stacker 13 to the interior side of the device from the front part of the device, as shown in FIGS. 24 and 25, an engaging part 95 of the tray 90 (see FIGS. 14 and 15) pushes up the lever part 76 to rotate the release member 75 clockwise in the drawing and place the pressing roller 78 on the horizontal surface 97 of the tray 90.

Then, when the tray 90 is further inserted to the inner part of the device from this state, the pressing roller 78 presses in contact with the horizontal surface 97 and the release member 75 further rotates. Thus, the sheet ejection frame Assy 45 is pushed upward. The positions of the pressing roller 78 described hereinafter when the pressing roller 78 presses the tray 90 indicate all the pressing position of the pressing roller 78.

When the tray 90 is further inserted to the inner side of the device, the release member 75 is located in a stable position where the release member 75 is not rotated by a reaction received from the tray 90 through the pressing roller 78 (a position shown in FIG. 26). Then, the pressing roller 78 climbs on the inclined surface 96 formed on the tray 90, so that the sheet ejection frame Assy 45 is furthermore pushed upward. As shown in FIG. 26, the sheet ejection frame Assy 45 is displaced to the separate position. Reference numerals 78' and 78" in FIG. 26 designate intermediate positions of the pressing roller 78.

Here, since the pressing roller 78 climbs on the inclined surface 96 so that the pressing roller gradually increases a pressing force for pressing the tray 90, a load is not abruptly increased in the process for inserting the tray 90 and the tray can be smoothly inserted without an uneasy feeling.

As described above, since the sheet ejection frame Assy 45 is displaced 10 to the separate position through the rotating operation of the release member 75 and the pressing roller 78 is displaced from the non-pressing position to the pressing position, the release stroke of the sheet ejection frame Assy 45 can be increased and the roller position changing unit 6 can be formed at low cost without increasing the number of parts as in the case of using a link mechanism.

Further, since the tray 90 is inserted to the transport path so that the tray 90 itself displaces the sheet ejection frame Assy 45 from the contact position to the separate position and displaces the pressing roller 78 from the non-pressing position to the pressing position, the ejecting follower roller 42 can be assuredly separated from the ejecting driving roller 41 without requiring a special operation, the pressing roller 78 can be displaced from the non-pressing position to the pressing position and a maneuverability of a user can be improved. Further, since the tray 90 is pressed to the ejecting driving roller 41 by the pressing roller 78, the floating of the tray 90, that is, the contact of the optical disk set on the tray 90 with the ejecting follower roller 52 can be assuredly prevented. Further, since the pressing roller 78 can freely rotate, a transport load when the tray 90 is transported can be limited to a minimum.

In this embodiment, an amount of displacement when the sheet ejection frame Assy 45 is displaced from the contact position to the separate position is about 5 mm. The amount of displacement includes an amount of displacement of about 3 mm by the position changing operation of the stacker 13 and an amount of displacement of about 2 mm when the tray 90 is inserted to rotate the release member 75 and the pressing roller 78 climbs on the inclined surface 96 formed on the tray 90.

In FIG. 26, since the tray 90 is nipped in between the pressing roller 78 and the ejecting driving roller 41, the tray 90 can be transported by rotating the ejecting driving roller 41. Then, the tray 90 is transported toward the transport roller 29 in the upstream side by the rotation of the ejecting driving roller 41. The end of the tray 90 smoothly enters between the transport driving roller 30 and the transport follower roller 31 by the action of the tongue piece 94 (FIGS. 14 and 15) formed on its end so that the tray 90 is nipped by the transport driving roller 30 and the transport follower roller 31. After that, the tray 90 is sub-scanning fed to the downstream side by the rotation of the transport driving roller 30 and a recording is carried out on the optical disk by the recording head 36.

Since the release member 75 is made to tend to rotate in the direction shown by the arrow mark γ in FIG. 22, when the tray 90 is discharged, the lever part 76 acts to push out the end of the tray 90 to an ejecting direction (rightward in FIGS. 22 to 26). Accordingly, the ejecting characteristics of the tray 90 are improved so that the tray 90 can be smoothly ejected.

Further, a plurality of pressing rollers 78 (in this embodiment, two) are provided and the positions thereof in the main scanning direction are symmetrical with respect to the center of the main scanning direction (in this embodiment, near both the side ends of the tray 90). Accordingly, when the tray 90 is transported by the pressing roller 78 and the ejecting driving roller 41, the tray can be properly transported without generating a skew:

When the sheet ejection frame Assy 45 is located in the contact position, the lever part 76 formed in the release member 75 protrudes to the sheet transport path by viewing the sheet transport path from the side. However, the lever part 76 is provided outside the sheet transport path in the main scanning direction not to prevent the sheet P from being ejected. Further, the pressing roller 78 is provided inside the sheet transport path in the main scanning direction, however, when the sheet ejection frame Assy 45 is located in the contact position, the pressing roller is retracted upward the sheet transport path as shown in FIG. 22, so that the pressing roller does not prevent the ejection of the sheet R <<5. Positional Relation Between Ejecting Driving Roller, Pressing Roller and Tray>>

Subsequently, the positional relation between the ejecting driving roller 41, the pressing roller 78 and the tray 90 will be described in detail. As described above, the tray 90 is pressed toward the ejecting driving roller 41 by the pressing roller 78. However, when the tray 90 is inserted to the recording unit 32 (FIG. 2) from the stacker 13, if the tray 90 receives a pressing force from the pressing roller 78 before the end 93 of the tray 90 reaches the ejecting driving roller 41, the end 93 of the tray 90 collides with the ejecting driving roller 41, in other words, a "hooked feeling" when the tray 90 is inserted is undesirably caused.

The ejecting driving roller 41 is arranged at a high position relative to the support surface 13*a* (more specifically, a top surface of the rib 82) of the tray 90, because when the tray 90 is inserted from the stacker 13, the ejecting driving roller 41 is allowed to assuredly come into contact with the bottom surface of the tray 90.

Further, when the tray 90 receives the pressing force from the pressing roller 78 before the end 93 of the tray 90 reaches the ejecting driving roller 41, the tray 90 pushes down the end part of the base end side of the stacker 13 so that the stacker 13 is pivoted counterclockwise on the shaft 65. Thus, in the first position, the stacker 13 cannot maintain a suitable position (in this embodiment, a horizontal position) for guiding the tray 90.

Thus, in this embodiment, before the pressing roller 78 presses the tray 90, the end 93 of the tray 90 is designed to reach the ejecting driving roller 41.

Specifically, FIG. 24 shows a state at a moment when the tongue piece 94 reaches the ejecting driving roller 41. As shown in the drawing, at this time, the pressing roller 78 does not yet press the tray 90. Then, FIG. 25 shows a moment when the pressing roller 78 is placed on the horizontal surface 97 (a moment when the pressing roller 78 is changed to the pressing position). At this time, the end 93 of the tray 90 already reaches the ejecting driving roller 41.

That is, the end 93 of the tray 90 is extended in the inserting direction of the tray 90 (leftward in the drawing) relative to the horizontal surface 97 as a position where the pressing roller 78 starts to press the tray 90. Accordingly, before the pressing roller 78 presses the tray 90, the end 93 of the tray 90 reaches the ejecting driving roller 41.

When the end 93 of the tray 90 is formed so as to reach the ejecting driving roller 41 before the pressing roller 78 presses the tray 90, the end 93 of the tray 90 is not extended, but the position of the ejecting driving roller 41 (the ejecting roller 40) may be arranged in the downstream side (rightward in the drawing). Further, the roller position changing unit 5 (the release member 75) may be formed so that at the same time as or after the end 93 of the tray 90 reaches the ejecting driving roller 41, the pressing roller 78 is placed on the upper surface of the tray 90 (the horizontal surface 97 or the inclined surface 96).

As described above, in the structure including the stacker 13 as the guide unit for guiding the tray 90, the ejecting driving roller 41 located between the stacker 13 and the recording unit 32 (FIG. 2), coming into contact with the bottom surface of the tray 90 and rotated and driven and the pressing roller 78 located in the side of the tray 90 relative to the ejecting driving roller 41 to press the tray 90 toward the ejecting driving roller 41 from the upper surface side of the tray 90, under a state that the tray 90 is pressed by the pressing roller 78, the end 93 of the tray 90 can be prevented from abutting on the ejecting driving roller 41.

Consequently, the generation of the "hooked feeling" when the tray 90 is inserted can be prevented, or a degree thereof can be greatly reduced. Further, since the pressing force for pressing the tray 90 by the pressing roller 78 is not directly transmitted to the stacker 13, an adverse influence is not given to the position (a horizontal position in this embodiment) of the stacker 13 located in the first position and the position for supporting the tray 90 can be maintained in a suitable state.

In the above-described embodiment, the tray 90 on which the optical disk is set is inserted to displace the sheet ejection frame Assy 45 from the contact position to the separate position and displace the pressing roller 78 from the non-pressing position to the pressing position. However, the thick board sheet may be inserted so that the sheet ejection frame Assy 45 can be displaced from the contact position to the separate position.

What is claimed is:

1. A transport system comprising:

a stacker, operable to be displaced between a first position where the stacker forms a part of a transport path in which a first medium is transported in a first direction and a second position where the stacker receives a second medium having transported from a downstream side of the stacker in the first direction, and operable to perform a pivot movement, the second position located below the first position; and a first changer, operable to change a position of the stacker, and including:

a first member, passing through the stacker in a second direction perpendicular to the first direction;

a second member, operable to guide the first member in a third direction perpendicular to the second direction;

a first regulator, disposed at an upstream side of the first member in the first direction, and operable to regulate the pivot movement so as to retain the stacker at the first position together with the first member and to retain the stacker in an upwardly inclined manner together with the first member after regulation of the first position is released or before the position of the stacker is changed to the first position;

a second regulator, disposed at a downstream side of the first member in the first direction, and operable to regulate the pivot movement so as to retain the stacker at the second position together with the first member and to retain the stacker in an upwardly inclined manner together with the first member before the position of the stacker is changed to the second position or after regulation of the second position is released, wherein when the first member is displaced downwardly in a state that the stacker is disposed at the first position, a state in which the stacker is regulated by the first member and the first regulator is changed to a state in which the stacker is regulated by the first member and the second regulator, and when the first member is displaced upwardly in a state that the stacker is disposed at the second position, a state in which the stacker is regulated by the first member and the second regulator is changed to a state in which the stacker is regulated by the first member and the first regulator;

the transport system further comprising:

a guide, operable to guide the first medium in the first direction, and included in the second member;

a driver, disposed at a downstream side of the guide in the first direction, and operable to come into contact with a bottom surface of the first medium;

a presser, disposed between the guide and the driver, and operable to be displaced between a pressing position where the presser presses an upper surface of the first medium toward the driver and a non-pressing position where the presser is separated from the upper surface of the first medium; and a second changer, adapted to be engaged with the first medium so as to displace the presser to the pressing position from the non-pressing position, wherein a leading end of the first medium reaches the driver before or at a time when the presser presses the first medium.

2. A recording apparatus comprising:

the transport system according to claim 1, and a recording apparatus, disposed at a downstream section in the first direction, and operable to record information on the first medium and the second medium.

3. A liquid ejecting apparatus comprising:

the transport system according to claim 1, and a liquid ejecting device, disposed at a downstream section in the first direction, and operable to eject liquid toward the first medium and the second medium.

* * * * *